US009208723B2

(12) United States Patent
Osame et al.

(10) Patent No.: US 9,208,723 B2
(45) Date of Patent: Dec. 8, 2015

(54) SEMICONDUCTOR DEVICE INCLUDING TRANSISTOR WITH OXIDE SEMICONDUCTOR

(75) Inventors: Mitsuaki Osame, Kanagawa (JP); Aya Anzai, Kanagawa (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 299 days.

(21) Appl. No.: 13/085,521

(22) Filed: Apr. 13, 2011

(65) Prior Publication Data

US 2011/0187762 A1 Aug. 4, 2011

Related U.S. Application Data

(63) Continuation of application No. 11/278,790, filed on Apr. 5, 2006, now Pat. No. 7,928,938.

(30) Foreign Application Priority Data

Apr. 19, 2005 (JP) ..... 2005-121730

(51) Int. Cl.
*G09G 3/32* (2006.01)
*G09G 3/20* (2006.01)

(52) U.S. Cl.
CPC ..... *G09G 3/3258* (2013.01); *G09G 3/2022* (2013.01); *G09G 2300/0857* (2013.01); *G09G 2310/0251* (2013.01); *G09G 2320/0223* (2013.01); *G09G 2330/023* (2013.01)

(58) Field of Classification Search
CPC ..... G09G 2/2022; G09G 3/3258
USPC ..... 345/82
See application file for complete search history.

(56) References Cited

U.S. PATENT DOCUMENTS 5,534,884 A 7/1996 Mase et al.
5,712,652 A 1/1998 Sato et al.
(Continued)

FOREIGN PATENT DOCUMENTS

EP 1103946 A2 5/2001
EP 1182636 A2 2/2002
(Continued)

OTHER PUBLICATIONS

Chinese Office Action (Application No. 200610075121.8) dated Feb. 5, 2010 with English Translation, 17 pages.
(Continued)

*Primary Examiner* — Kwang-Su Yang
(74) *Attorney, Agent, or Firm* — Fish & Richardson P.C.

(57) ABSTRACT

A semiconductor device of the invention includes a data line, a power source line, a first scan line, a second scan line, a first transistor, a second transistor, a memory circuit, a third transistor, and a light-emitting element. A gate of the first transistor is connected to the data line, and a first terminal thereof is connected to the power source line; a gate of the second transistor is connected to the first scan line, and a first terminal thereof is connected to a second terminal of the first transistor; the memory circuit is connected to a second terminal of the second transistor and the second scan line; a first terminal of the third transistor is connected to the light-emitting element; and the memory circuit holds a first potential inputted from the power source line or a second potential inputted from the second scan line, and applies the potential to a gate of the third transistor to control emission/non-emission of the light-emitting element.

27 Claims, 24 Drawing Sheets

(56) References Cited

U.S. PATENT DOCUMENTS 5,731,856 A 3/1998 Kim et al.
5,744,864 A 4/1998 Cillessen et al.
5,945,972 A 8/1999 Okumura et al.
6,294,274 B1 9/2001 Kawazoe et al.
6,535,185 B2 3/2003 Kim et al.
6,563,174 B2 5/2003 Kawasaki et al.
6,693,383 B2 2/2004 Bae et al.
6,727,522 B1 4/2004 Kawasaki et al.
6,730,966 B2 5/2004 Koyama
6,765,549 B1 7/2004 Yamazaki et al.
6,774,876 B2 8/2004 Inukai
6,937,222 B2 8/2005 Numao
6,975,298 B2 12/2005 Koyama et al.
6,982,462 B2 1/2006 Koyama
7,009,590 B2 3/2006 Numao
7,042,447 B2 5/2006 Numao
7,049,190 B2 5/2006 Takeda et al.
7,061,014 B2 6/2006 Hosono et al.
7,064,346 B2 6/2006 Kawasaki et al.
7,088,322 B2 8/2006 Koyama et al.
7,105,868 B2 9/2006 Nause et al.
7,113,154 B1 9/2006 Inukai
7,151,511 B2 12/2006 Koyama
7,211,825 B2 5/2007 Shih et al
7,282,782 B2 10/2007 Hoffman et al.
7,297,977 B2 11/2007 Hoffman et al.
7,301,521 B2 11/2007 Miyazawa et al.
7,319,443 B2 1/2008 Kimura et al.
7,323,356 B2 1/2008 Hosono et al.
7,385,224 B2 6/2008 Ishii et al.
7,402,506 B2 7/2008 Levy et al.
7,411,209 B2 8/2008 Endo et al.
7,425,939 B2 * 9/2008 Asano ..... 345/76
7,453,065 B2 11/2008 Saito et al.
7,453,087 B2 11/2008 Iwasaki
7,462,862 B2 12/2008 Hoffman et al.
7,468,304 B2 12/2008 Kaji et al.
7,501,293 B2 3/2009 Ito et al.
7,674,650 B2 3/2010 Akimoto et al.
7,732,819 B2 6/2010 Akimoto et al.
7,800,298 B2 * 9/2010 Tsai et al. ..... 313/504
8,088,652 B2 * 1/2012 Hayashi et al. ..... 438/149
8,659,517 B2 * 2/2014 Osame et al. ..... 345/76
2001/0046027 A1 11/2001 Tai et al.
2002/0036604 A1 3/2002 Yamazaki et al.
2002/0044111 A1 * 4/2002 Yamazaki et al. ..... 345/83
2002/0056838 A1 5/2002 Ogawa
2002/0132454 A1 9/2002 Ohtsu et al.
2002/0140642 A1 10/2002 Okamoto
2003/0058200 A1 3/2003 Numao
2003/0137503 A1 * 7/2003 Kimura et al. ..... 345/212
2003/0189401 A1 10/2003 Kido et al.
2003/0218222 A1 11/2003 Wager, III et al.
2004/0038446 A1 2/2004 Takeda et al.
2004/0127038 A1 7/2004 Carcia et al.
2004/0235225 A1 * 11/2004 Ohtani et al. ..... 438/151
2004/0263440 A1 * 12/2004 Kimura et al. ..... 345/76
2004/0263741 A1 12/2004 Koyama et al.
2005/0017302 A1 1/2005 Hoffman
2005/0074963 A1 * 4/2005 Fujii et al. ..... 438/623
2005/0190126 A1 9/2005 Kimura et al.
2005/0199959 A1 9/2005 Chiang et al.
2005/0275038 A1 * 12/2005 Shih et al. ..... 257/382
2005/0285823 A1 12/2005 Kimura et al.
2006/0033098 A1 * 2/2006 Shih et al. ..... 257/40
2006/0033161 A1 2/2006 Koyama
2006/0035452 A1 2/2006 Carcia et al.
2006/0043377 A1 3/2006 Hoffman et al.
2006/0091793 A1 5/2006 Baude et al.
2006/0097973 A1 * 5/2006 Sun ..... 345/92
2006/0108529 A1 5/2006 Saito et al.
2006/0108636 A1 5/2006 Sano et al.
2006/0108941 A1 5/2006 Yang et al.
2006/0110867 A1 5/2006 Yabuta et al.
2006/0113536 A1 6/2006 Kumomi et al.
2006/0113539 A1 6/2006 Sano et al.
2006/0113549 A1 6/2006 Den et al.
2006/0113565 A1 6/2006 Abe et al.
2006/0169973 A1 8/2006 Isa et al.
2006/0170111 A1 8/2006 Isa et al.
2006/0197092 A1 9/2006 Hoffman et al.
2006/0208977 A1 9/2006 Kimura
2006/0228974 A1 10/2006 Thelss et al.
2006/0231882 A1 10/2006 Kim et al.
2006/0238135 A1 10/2006 Kimura
2006/0244107 A1 11/2006 Sugihara et al.
2006/0284171 A1 12/2006 Levy et al.
2006/0284172 A1 12/2006 Ishii
2006/0292777 A1 12/2006 Dunbar
2007/0024187 A1 2/2007 Shin et al.
2007/0046191 A1 3/2007 Saito
2007/0052025 A1 3/2007 Yabuta
2007/0054507 A1 3/2007 Kaji et al.
2007/0090365 A1 4/2007 Hayashi et al.
2007/0108446 A1 5/2007 Akimoto
2007/0152217 A1 7/2007 Lai et al.
2007/0172591 A1 7/2007 Seo et al.
2007/0187678 A1 8/2007 Hirao et al.
2007/0187760 A1 8/2007 Furuta et al.
2007/0194379 A1 8/2007 Hosono et al.
2007/0252928 A1 11/2007 Ito et al.
2007/0272922 A1 11/2007 Kim et al.
2007/0287296 A1 12/2007 Chang
2008/0006877 A1 1/2008 Mardilovich et al.
2008/0038882 A1 2/2008 Takechi et al.
2008/0038929 A1 2/2008 Chang
2008/0050595 A1 2/2008 Nakagawara et al.
2008/0073653 A1 3/2008 Iwasaki
2008/0083950 A1 4/2008 Pan et al.
2008/0106191 A1 5/2008 Kawase
2008/0128689 A1 6/2008 Lee et al.
2008/0129195 A1 6/2008 Ishizaki et al.
2008/0166834 A1 7/2008 Kim et al.
2008/0182358 A1 7/2008 Cowdery-Corvan et al.
2008/0224133 A1 9/2008 Park et al.
2008/0254569 A1 * 10/2008 Hoffman et al. ..... 438/104
2008/0258139 A1 10/2008 Ito et al.
2008/0258140 A1 10/2008 Lee et al.
2008/0258141 A1 10/2008 Park et al.
2008/0258143 A1 10/2008 Kim et al.
2008/0296568 A1 12/2008 Ryu et al.
2009/0068773 A1 3/2009 Lai et al.
2009/0073325 A1 3/2009 Kuwabara et al.
2009/0114910 A1 5/2009 Chang
2009/0134399 A1 5/2009 Sakakura et al.
2009/0152506 A1 6/2009 Umeda et al.
2009/0152541 A1 6/2009 Maekawa et al.
2009/0278122 A1 11/2009 Hosono et al.
2009/0280600 A1 11/2009 Hosono et al.
2010/0065844 A1 3/2010 Tokunaga
2010/0092800 A1 4/2010 Itagaki et al.
2010/0109002 A1 5/2010 Itagaki et al.
2010/0124796 A1 * 5/2010 Yamazaki et al. ..... 438/29

FOREIGN PATENT DOCUMENTS

EP 1 737 044 A1 12/2006
EP 2 226 847 A2 9/2010
JP 60-198861 A 10/1985
JP 63-210022 A 8/1988
JP 63-210023 A 8/1988
JP 63-210024 A 8/1988
JP 63-215519 A 9/1988
JP 63-239117 A 10/1988
JP 63-265818 A 11/1988
JP 05-251705 A 9/1993
JP 08-264794 A 10/1996
JP 09-212140 A 8/1997
JP 11-505377 A 5/1999
JP 2000-044236 A 2/2000
JP 2000-150900 A 5/2000
JP 2001-343933 A 12/2001
JP 2002-076356 A 3/2002
JP 2002-140034 A 5/2002

(56) References Cited

FOREIGN PATENT DOCUMENTS

| | | | |
|---|---|---|---|
| JP | 2002-287665 | A | 10/2002 |
| JP | 2002-289859 | A | 10/2002 |
| JP | 2003-086000 | A | 3/2003 |
| JP | 2003-086808 | A | 3/2003 |
| JP | 2003-150133 | A | 5/2003 |
| JP | 2003-167561 | A | 6/2003 |
| JP | 2003-208126 | A | 7/2003 |
| JP | 2004-103957 | A | 4/2004 |
| JP | 2004-110015 | A | 4/2004 |
| JP | 2004-163601 | A | 6/2004 |
| JP | 2004-273614 | A | 9/2004 |
| JP | 2004-273732 | A | 9/2004 |
| JP | 2005-049402 | A | 2/2005 |
| JP | 2006-208743 | A | 8/2006 |
| WO | WO 2004/021326 | A1 | 3/2004 |
| WO | 2004/114391 | A1 | 12/2004 |

OTHER PUBLICATIONS

Asakuma, N et al, "Crystallization and Reduction of Sol-Gel-Derived Zinc Oxide Films by Irradiation With Ultraviolet Lamp," Journal of Sol-Gel Science and Technology, 2003, vol. 26, pp. 181-184.

Asaoka, Y et al., "29.1: Polarizer-Free Reflective LCD Combined With Ultra Low-Power Driving Technology," SID Digest '09 : SID International Symposium Digest of Technical Papers, 2009, pp. 395-398.

Chern, H et al., "An Analytical Model for the Above-Threshold Characteristics of Polysilicon Thin-Film Transistors," IEEE Transactions on Electron Devices, Jul. 1, 1995, vol. 42, No. 7, pp. 1240-1246.

Cho, D et al., "21.2: Al and Sn-Doped Zinc Indium Oxide Thin Film Transistors for AMOLED Back-Plane," SID Digest '09 : SID International Symposium Digest of Technical Papers, May 31, 2009, pp. 280-283.

Clark, S et al., "First Principles Methods Using CASTEP," Zeitschrift fur Kristallographie, 2005, vol. 220, pp. 567-570.

Coates. D et al., "Optical Studies of the Amorphous Liquid-Cholesteric Liquid Crystal Transition: The Blue Phase," Physics Letters, Sep. 10, 1973, vol. 45A, No. 2, pp. 115-116.

Costello, M et al., "Electron Microscopy of a Cholesteric Liquid Crystal and Its Blue Phase," Phys. Rev. A (Physical Review. A), May 1, 1984, vol. 29, No. 5, pp. 2957-2959.

Dembo, H et al., "RFCPUS on Glass and Plastic Substrates Fabricated by TFT Transfer Technology," IEDM 05: Technical Digest of International Electron Devices Meeting, Dec. 5, 2005, pp. 1067-1069.

Fortunato, E et al., "Wide-Bandgap High-Mobility ZnO Thin-Film Transistors Produced at Room Temperature," Appl. Phys. Lett. (Applied Physics Letters), Sep. 27, 2004, vol. 85, No. 13, pp. 2541-2543.

Fung, T et al., "2-D Numerical Simulation of High Performance Amorphous In—Ga—Zn—O TFTs for Flat Panel Displays," AM-FPD '08 Digest of Technical Papers, Jul. 2, 2008, pp. 251-252, The Japan Society of Applied Physics.

Godo, H et al., "P-9: Numerical Analysis on Temperature Dependence of Characteristics of Amorphous In—Ga—Zn—Oxide TFT," SID Digest '09 : SID International Symposium Digest of Technical Papers, May 31, 2009, pp. 1110-1112.

Godo, H et al., "Temperature Dependence of Characteristics and Electronic Structure for Amorphous In—Ga—Zn—Oxide TFT," AM-FPD '09 Digest of Technical Papers, Jul. 1, 2009, pp. 41-44.

Hayashi, R et al., "42.1: Invited Paper: Improved Amorphous In—Ga—Zn—O TFTs," SID Digest '08 : SID International Symposium Digest of Technical Papers, May 20, 2008, vol. 39, pp. 621-624.

Hirao, T et al., "Novel Top-Gate Zinc Oxide Thin-Film Transistors (ZnO TFTs) for AMLCDs," Journal of the SID , 2007, vol. 15, No. 1, pp. 17-22.

Hosono, H et al., "Working hypothesis to explore novel wide band gap electrically conducting amorphous oxides and examples," J. Non-Cryst. Solids (Journal of Non-Crystalline Solids), 1996, vol. 198-200, pp. 165-169.

Hosono, H, "68.3: Invited Paper:Transparent Amorphous Oxide Semiconductors for High Performance TFT," SID Digest '07 : SID International Symposium Digest of Technical Papers, 2007, vol. 38, pp. 1830-1833.

Hsieh, H et al., "P-29: Modeling of Amorphous Oxide Semiconductor Thin Film Transistors and Subgap Density of States," SID Digest '08 : SID International Symposium Digest of Technical Papers, 2008, vol. 39, pp. 1277-1280.

Ikeda, T et al., "Full-Functional System Liquid Crystal Display Using CG-Silicon Technology," SID Digest '04 : SID International Symposium Digest of Technical Papers, 2004, vol. 35, pp. 860-863.

Janotti, A et al., "Native Point Defects in ZnO," Phys. Rev. B (Physical Review. B), 2007, vol. 76, No. 16, pp. 165202-1-165202-22.

Janotti, A et al., "Oxygen Vacancies in ZnO," Appl. Phys. Lett. (Applied Physics Letters), 2005, vol. 87, pp. 122102-1-122102-3.

Jeong, J et al., "3.1: Distinguished Paper: 12.1-Inch WXGA AMOLED Display Driven by Indium—Gallium—Zinc Oxide TFTs Array," SID Digest '08 : SID International Symposium Digest of Technical Papers, May 20, 2008, vol. 39, No. 1, pp. 1-4.

Jin, D et al., "65.2: Distinguished Paper:World-Largest (6.5") Flexible Full Color Top Emission AMOLED Display on Plastic Film and Its Bending Properties," SID Digest '09 : SID International Symposium Digest of Technical Papers, May 31, 2009, pp. 983-985.

Kanno, H et al., "White Stacked Electrophosphorecent Organic Light-Emitting Devices Employing MOO3 as a Charge-Generation Layer," Adv. Mater. (Advanced Materials), 2006, vol. 18, No. 3, pp. 339-342.

Kikuchi, H et al., "39.1: Invited Paper: Optically Isotropic Nano-Structured Liquid Crystal Composites for Display Applications," SID Digest '09 : SID International Symposium Digest of Technical Papers, May 31, 2009, pp. 578-581.

Kikuchi, H et al., "62.2: Invited Paper: Fast Electro-Optical Switching in Polymer-Stabilized Liquid Crystalline Blue Phases for Display Application," SID Digest '07 : SID International Symposium Digest of Technical Papers, 2007, vol. 38, pp. 1737-1740.

Kikuchi, H et al., "Polymer-Stabilized Liquid Crystal Blue Phases," Nature Materials, Sep. 1, 2002, vol. 1, pp. 64-68.

Kim, S et al., "High-Performance oxide thin film transistors passivated by various gas plasmas," The Electrochemical Society, 214th ECS Meeting, 2008, No. 2317, 1 page.

Kimizuka, N et al., "Spinel,YbFe2O4, and Yb2Fe3O7 Types of Structures for Compounds in the In2O3 and Sc2O3—A2O3—BO Systems [A; Fe, Ga, or Al; B: Mg, Mn, Fe, Ni, Cu,or Zn] At Temperatures Over 1000° C.," Journal of Solid State Chemistry, 1985, vol. 60, pp. 382-384.

Kimizuka, N et al., "Syntheses and Single-Crystal Data of Homologous Compounds, In2O3(ZnO)m (m=3, 4, and 5), InGaO3(ZnO)3, and Ga2O3(ZnO)m (m=7, 8, 9, and 16) in the In2O3—ZnGa2O4—ZnO System," Journal of Solid State Chemistry, Apr. 1, 1995, vol. 116, No. 1, pp. 170-178.

Kitzerow, H et al., "Observation of Blue Phases in Chiral Networks," Liquid Crystals, 1993, vol. 14, No. 3, pp. 911-916.

Kurokawa, Y et al., "UHF RFCPUS on Flexible and Glass Substrates for Secure RFID Systems," Journal of Solid-State Circuits , 2008, vol. 43, No. 1, pp. 292-299.

Lany, S et al., "Dopability, Intrinsic Conductivity, and Nonstoichiometry of Transparent Conducting Oxides," Phys. Rev. Lett. (Physical Review Letters), Jan. 26, 2007, vol. 98, pp. 045501-1-045501-4.

Lee, H et al., "Current Status of, Challenges to, and Perspective View of AM-OLED," IDW '06 : Proceedings of the 13th International Display Workshops, Dec. 7, 2006, pp. 663-666.

Lee, J et al., "World's Largest (15-Inch) XGA AMLCD Panel Using IGZO Oxide TFT," SID Digest '08 : SID International Symposium Digest of Technical Papers, May 20, 2008, vol. 39, pp. 625-628.

Lee, M et al., "15.4: Excellent Performance of Indium—Oxide-Based Thin-Film Transistors by DC Sputtering," SID Digest '09 : SID International Symposium Digest of Technical Papers, May 31, 2009, pp. 191-193.

Li, C et al., "Modulated Structures of Homologous Compounds InMO3(ZnO)m (M=In, Ga; m=Integer) Described by Four-Dimensional Superspace Group," Journal of Solid State Chemistry, 1998, vol. 139, pp. 347-355.

(56) References Cited

OTHER PUBLICATIONS

Masuda, S et al., "Transparent thin film transistors using ZnO as an active channel layer and their electrical properties," J. Appl. Phys. (Journal of Applied Physics), Feb. 1, 2003, vol. 93, No. 3, pp. 1624-1630.
Meiboom, S et al., "Theory of the Blue Phase of Cholesteric Liquid Crystals," Phys. Rev. Lett. (Physical Review Letters), May 4, 1981, vol. 46, No. 18, pp. 1216-1219.
Miyasaka, M, "Suftla Flexible Microelectronics on Their Way to Business," SID Digest '07 : SID International Symposium Digest of Technical Papers, 2007, vol. 38, pp. 1673-1676.
Mo, Y et al., "Amorphous Oxide TFT Backplanes for Large Size AMOLED Displays," IDW '08 : Proceedings of the 6th International Display Workshops, Dec. 3, 2008, pp. 581-584.
Nakamura, "Synthesus of Homologous Compound with New Long-Period Structure," NIRIM Newsletter, Mar. 1995, vol. 150, pp. 1-4 with English translation.
Nakamura, M et al., "The phase relations in the In2O3—Ga2ZnO4—ZnO system at 1350° C.," Journal of Solid State Chemistry, Aug. 1, 1991, vol. 93, No. 2, pp. 298-315.
Nomura, K et al., "Thin-Film Transistor Fabricated in Single-Crystalline Transparent Oxide Semiconductor," Science, May 23, 2003, vol. 300, No. 5623, pp. 1269-1272.
Nomura, K et al., "Amorphous Oxide Semiconductors for High-Performance Flexible Thin-Film Transistors," Jpn. J. Appl. Phys. (Japanese Journal of Applied Physics) , 2006, vol. 45, No. 5B, pp. 4303-4308
Nomura, K et al., "Room-Temperature Fabrication of Transparent Flexible Thin-Film Transistors Using Amorphous Oxide Semiconductors," Nature, Nov. 25, 2004, vol. 432, pp. 488-492
Nomura, K et al., "Carrier transport in transparent oxide semiconductor with intrinsic structural randomness probed using single-crystalline InGaO3(ZnO)5 films," Appl. Phys. Lett. (Applied Physics Letters) , Sep. 13, 2004, vol. 85, No. 11, pp. 1993-1995.
Nowatari, H et al., "60.2: Intermediate Connector With Suppressed Voltage Loss for White Tandem OLEDs," SID Digest '09 : SID International Symposium Digest of Technical Papers, May 31, 2009, vol. 40, pp. 899-902.
Oba, F et al., "Defect energetics in ZnO: A hybrid Hartree-Fock density functional study," Phys. Rev. B (Physical Review. B), 2008, vol. 77, pp. 245202-1-245202-6.
Oh, M et al., "Improving the Gate Stability of ZnO Thin-Film Transistors with Aluminum Oxide Dielectric Layers," J. Electrochem. Soc. (Journal of The Electrochemical Society), 2008, vol. 155, No. 12, pp. H1009-H1014.
Ohara, H et al., "21.3: 4.0 In. QVGA AMOLED Display Using In—Ga—Zn—Oxide TFTs with a Novel Passivation Layer," SID Digest '09 : SID International Symposium Digest of Technical Papers, May 31, 2009, pp. 284-287.
Ohara, H et al., "Amorphous In—Ga—Zn—Oxide TFTs with Suppressed Variation for 4.0 inch QVGA AMOLED Display," AM-FPD '09 Digest of Technical Papers, Jul. 1, 2009, pp. 227-230, The Japan Society of Applied Physics.
Orita, M et al., "Amorphous transparent conductive oxide InGaO3(ZnO)m (m<4):a Zn4s conductor," Philosophical Magazine, 2001, vol. 81, No. 5, pp. 501-515.
Orita, M et al., "Mechanism of Electrical Conductivity of Transparent InGaZnO4," Phys. Rev. B (Physical Review. B), Jan. 15, 2000, vol. 61, No. 3, pp. 1811-1816.
Osada, T et al., "15.2: Development of Driver-Integrated Panel using Amorphous In—Ga—Zn—Oxide TFT," SID Digest '09 : SID International Symposium Digest of Technical Papers, May 31, 2009, pp. 184-187.
Osada, T et al., "Development of Driver-Integrated Panel Using Amorphous In—Ga—Zn—Oxide TFT," AM-FPD '09 Digest of Technical Papers, Jul. 1, 2009, pp. 33-36.
Park, J et al., "Dry etching of ZnO films and plasma-induced damage to optical properties," J. Vac. Sci. Technol. B (Journal of Vacuum Science & Technology B), Mar. 1, 2003, vol. 21, No. 2, pp. 800-803.
Park, J et al., "Improvements in the Device Characteristics of Amorphous Indium Gallium Zinc Oxide Thin-Film Transistors by Ar Plasma Treatment," Appl. Phys. Lett. (Applied Physics Letters), Jun. 26, 2007, vol. 90, No. 26, pp. 262106-1-262106-3.
Park, J et al., "Electronic Transport Properties of Amorphous Indium—Gallium—Zinc Oxide Semiconductor Upon Exposure to Water," Appl. Phys. Lett. (Applied Physics Letters), 2008, vol. 92, pp. 072104-1-072104-3.
Park, J et al., "High performance amorphous oxide thin film transistors with self-aligned top-gate structure," IEDM 09: Technical Digest of International Electron Devices Meeting, Dec. 7, 2009, pp. 191-194
Park, Sang-Hee et al., "42.3: Transparent ZnO Thin Film Transistor for the Application of High Aperture Ratio Bottom Emission AM-OLED Display," SID Digest '08 : SID International Symposium Digest of Technical Papers, May 20, 2008, vol. 39, pp. 629-632.
Park, J et al., "Amorphous Indium—Gallium—Zinc Oxide TFTs and Their Application for Large Size AMOLED," AM-FPD '08 Digest of Technical Papers, Jul. 2, 2008, pp. 275-278.
Park, S et al., "Challenge to Future Displays: Transparent AM-OLED Driven by Peald Grown ZnO TFT," IMID '07 Digest, 2007, pp. 1249-1252.
Prins, M et al., "A Ferroelectric Transparent Thin-Film Transistor," Appl. Phys. Lett. (Applied Physics Letters), Jun. 17, 1996, vol. 68, No. 25, pp. 3650-3652
Sakata, J et al., "Development of 4.0-In. AMOLED Display With Driver Circuit Using Amorphous In—Ga—Zn—Oxide TFTs," IDW '09 : Proceedings of the 16th International Display Workshops, 2009, pp. 689-692.
Son, K et al., "42.4L: Late-News Paper: 4 Inch QVGA AMOLED Driven by the Threshold Voltage Controlled Amorphous GIZO (Ga2O3—In2O3—ZnO) TFT," SID Digest '08 : SID International Symposium Digest of Technical Papers, May 20, 2008, vol. 39, pp. 633-636
Takahashi, M et al., "Theoretical Analysis of IGZO Transparent Amorphous Oxide Semiconductor," IDW '08 : Proceedings of the 15th International Display Workshops, Dec. 3, 2008, pp. 1637-1640.
Tsuda, K et al., "Ultra Low Power Consumption Technologies for Mobile TFT-LCDs," IDW '02 : Proceedings of the 9th International Display Workshops, Dec. 4, 2002, pp. 295-298.
Ueno, K et al., "Field-Effect Transistor on SrTiO3 with Sputtered Al2O3 Gate Insulator," Appl. Phys. Lett. (Applied Physics Letters), Sep. 1, 2003, vol. 83, No. 9, pp. 1755-1757.
Van De Walle, C, "Hydrogen as a Cause of Doping in Zinc Oxide," Phys. Rev. Lett. (Physical Review Letters), Jul. 31, 2000, vol. 85, No. 5, pp. 1012-1015.

* cited by examiner

PRIOR ART

PRIOR ART

SEMICONDUCTOR DEVICE INCLUDING TRANSISTOR WITH OXIDE SEMICONDUCTOR

CROSS-REFERENCE TO RELATED APPLICATIONS

This application is a continuation of U.S. application Ser. No. 11/278,790, filed Apr. 5, 2006, now allowed, which claims the benefit of a foreign priority application filed in Japan as Serial No. 2005-121730 on Apr. 19, 2005, both of which are incorporated by reference.

BACKGROUND OF THE INVENTION

1. Field of the Invention

The present invention relates to a semiconductor device. In particular, the invention relates to a semiconductor device constructed by using transistors. In addition, the invention relates to a display device having the semiconductor device and an electronic apparatus having the display device.

Note that the semiconductor device herein means all devices that can function by utilizing the semiconductor characteristics.

2. Description of the Related Art

In recent years, self-luminous display devices having pixels each formed with a light-emitting element such as a light-emitting diode (LED) are drawing attention. As a light-emitting element used in such self-luminous display devices, there is an organic light-emitting diode (also referred to as an OLED (Organic Light-Emitting Diode), an organic EL element, an electroluminescence (EL) element, or the like), which is drawing attention to be used for EL displays. Since a light-emitting element such as an OLED is a self-luminous type, various advantages can be provided such that high visibility of pixels is ensured as compared to a liquid crystal display, no back light is required, high response speed is achieved and the like.

A self-luminous display device is constructed of a display and a peripheral circuit for inputting signals to the display. By disposing a light-emitting element in each pixel of the display and controlling emission/non-emission of each light-emitting element, images are displayed.

In each pixel of the display, a thin film transistor (hereinafter referred to as a TFT) is disposed. Here, description is made on a pixel configuration where two TFTs are disposed in each pixel in order to control emission/non-emission of a light-emitting element in each pixel (see Patent Document 1).

FIG. 21 shows a pixel configuration of a display. In a pixel portion 2100, data lines (also referred to as source signal lines) S1 to Sx, scan lines (also referred to as gate signal lines) G1 to Gy, and power source lines (also referred to as power supply lines) V1 to Vx are disposed. In addition, pixels of x (x is a natural number) columns and y (y is a natural number) rows are disposed. Each pixel has a selection transistor (also referred to as a switching TFT, a switch transistor or a SWTFT) 2101, a driving transistor (also referred to as a driving TFT) 2102, a holding capacitor 2103, and a light-emitting element 2104.

Description is made briefly on a driving method of the pixel portion 2100. When a scan line is selected in a selection period, the selection transistor 2101 is turned on and a potential of a data line at the time is written into a gate electrode (also referred to as a gate terminal) of the driving transistor 2102 through the selection transistor 2101. In the period after the selection period has terminated and until the next selection period starts, a potential of the gate electrode of the driving transistor 2102 is held in the holding capacitor 2103.

In the configuration of FIG. 21, when the relationship between the absolute values of a gate-source voltage (|Vgs|) of the driving transistor 2102 and the threshold voltage (|Vth|) of the driving transistor 2102 satisfies |Vgs|>|Vth|, the driving transistor 2102 is turned on and a current flows into the light-emitting element 2104 by a voltage between the power source line and a counter electrode connected to the light-emitting element 2104, thereby the light-emitting element 2104 is turned into the emission state. Meanwhile, when |Vgs|<|Vth| is satisfied, the driving transistor 2102 is turned off and no voltage is applied to the opposite electrodes of the light-emitting element 2104, thereby the light-emitting element 2104 is turned into the non-emission state.

In the pixel having the configuration of FIG. 21, two types of driving method are generally used for expressing gray scales, which are an analog gray scale method and a digital gray scale method.

The analog gray scale method is a method for expressing gray scales by changing the luminance of a light-emitting element, using an analog signal for a signal inputted to each pixel. On the other hand, the digital gray scale method is a method for expressing gray scales by controlling emission/non-emission of a light-emitting element only by controlling on/off of a switching element, using a signal inputted to each pixel.

In comparison with the analog gray scale method, the digital gray scale method is advantages in that it is hardly affected by characteristic variations of TFTs, and thus gray scales can be expressed more accurately.

As an example of the digital gray scale method, there is a time gray scale method. In the time gray scale method, gray scales are expressed by controlling the emission period of each pixel of a display device. Further, by using an erasing transistor (also referred to as an erasing TFT) in addition to the driving transistor and the selection transistor in each pixel in combination with the digital time gray scale method as disclosed in Patent Document 1, multi-gray scale display with high resolution can be achieved. In this specification, such a driving method is called an SES (Simultaneous Erasing Scan) drive.

In addition, in recent years, a display device having such a pixel configuration has been known that: a memory is incorporated in each pixel of a display portion in order to reduce power consumption of the display device (see Patent Document 2 and Patent Document 3).

[Patent Document 1] Japanese Patent Laid-Open No. 2001-343933

[Patent Document 2] Japanese Patent Laid-Open No. 2002-140034

[Patent Document 3] Japanese Patent Laid-Open No. 2005-049402

In the aforementioned pixel configuration disclosed in Patent Document 1, the power consumption of a data line driver circuit largely depends on the charging/discharging of a buffer therein. The power consumption P is generally calculated by using the following Formula (1), where F is frequency, C is capacitance, and V is voltage.

$$P=FCV^2 \text{ (}F\text{: Frequency, }C\text{: Capacitance, and }V\text{: Voltage)} \quad (1)$$

From the Formula (1), it can be seen that the voltage of a data line is desirably set to have a small amplitude by the data line driver circuit. Therefore, the voltage of a data line is set to have the minimum amplitude that allows on/off operation of the driving transistor. In other words, it is desirable to set the absolute value of a gate-source voltage (hereinafter referred to as Vgs) of the driving transistor to be large enough to certainly control the on/off operation of the driving transistor.

A potential of a data line to be inputted into a pixel is held in a holding capacitor after a selection period for turning on the selection transistor has terminated and until the next selection period for turning on the selection transistor starts.

However, there is such a problem that a potential that has been accumulated in the holding capacitor to be applied to the gate electrode of the driving transistor may fluctuate due to the effect of noise, a leakage potential from the selection transistor and the like, and thus the driving transistor may malfunction without being capable of keeping the normal on/off state.

In addition, there is another problem that the power consumption is undesirably increased if the voltage amplitude of the data line is increased in order to prevent malfunctions of the driving transistor that would be caused by fluctuations of a gate potential of the driving transistor. It can be seen from Formula (1) that the power consumption of a data line driver circuit increases in proportion to the square of a voltage; therefore, an increase in the voltage amplitude of a data line has a big influence on the power consumption.

Description is made in more detail with reference to FIG. 22 on problems concerning the conventional technique. In the pixel configuration shown in FIG. 22A, a pixel 2200 has a selection transistor 2201, a driving transistor 2202, a holding capacitor 2203, and a light-emitting element 2204. Note that the light-emitting element is driven with digital signals. In addition, the selection transistor is an n-channel transistor and the driving transistor is a p-channel transistor.

Description is made on a specific potential value of each power source line in FIG. 22A. A potential of a counter electrode 2208 of the light-emitting element 2204 is GND (hereinafter, 0 V), a potential of a power source line 2207 is 7 V, a high potential level (hereinafter indicated as an H level, an H potential or H) of a data line 2206 is 7 V, a low potential level (hereinafter indicated as an L level, an L potential or L) of the data line 2206 is 0 V, an H potential of a scan line 2205 is 10 V, and an L potential of the scan line 2205 is 0 V.

Needless to say, a potential of each wire, polarity of each transistor and the like are only examples, and therefore, the invention is not limited to them.

FIG. 22B shows a timing chart of potentials at the scan line, the data line and the node G when the light-emitting element is in the emission or non-emission state. In the period when the scan line 2205 is at 10 V, the selection transistor 2201 is turned on, and the node G receives a potential of the data line 2206. Thus, the potential of the data line 2206 is held in the holding capacitor 2203. If the potential held in the holding capacitor 2203 is not lower than the H potential, namely 7 V or more, the potential difference between the gate and source of the driving transistor 2202 becomes lower than the absolute value of the threshold voltage of the driving transistor 2202, thereby the driving transistor 2202 is turned off and the light-emitting element 2204 is turned into the non-emission state. On the other hand, if the potential held in the holding capacitor 2203 is not higher than the L potential, namely 0 V or less, the potential difference between the gate and source of the driving transistor 2202 becomes higher than the absolute value of the threshold voltage of the driving transistor 2202, thereby the driving transistor 2202 is turned on and the light-emitting element 2204 is turned into the emission state.

In the pixel configuration shown herein, a potential of the data line 2206 is directly written into the node G. Since the potential of the node G that is supplied from the data line 2206 controls on/off of the driving transistor 2202, the H potential of the data line 2206 is required to be equal to or higher than the potential of the power source line 2207, while the L potential of the data line 2206 is requited to be high enough to turn on the driving transistor 2202. In other words, it is required that the relationship between the voltage (Vel) applied to the light-emitting element 2204 and the source-drain voltage (Vds) of the driving transistor 2202 satisfy a condition to become Vel>Vds, which is required for operating the driving transistor 2202 in the linear region.

However, there is such a possibility that the potential of the node G may fluctuate due to variations or fluctuations of the threshold voltage of the driving transistor 2202, noise from outside during a holding period, a leakage potential from the selection transistor 2201 as shown in FIG. 22B, and the like, in which case the potential difference between the gate and source of the driving transistor 2202 fluctuates, and thus the driving transistor 2202 may malfunction without being capable of keeping the normal on/off state.

Thus, a semiconductor device having a conventional pixel configuration has a problem in that a potential applied to the gate electrode of the driving transistor fluctuates due to noise or a leakage potential from the selection transistor, which causes the driving transistor to malfunction. Further, even if a signal having a large potential amplitude is supplied from a data line, which is large enough to ensure the stable operation of the driving transistor, there arises another problem that the power consumption of a data line driver circuit is increased.

SUMMARY OF THE INVENTION

The invention is made in view of the foregoing problems, and the invention provides a semiconductor device, a display device having the semiconductor device and an electronic apparatus having the display device in order to overcome the foregoing problems.

One aspect of a semiconductor device of the invention includes a data line, a power source line, a first scan line, a second scan line, a first transistor, a second transistor, a memory circuit, a third transistor, and a light-emitting element. A gate of the first transistor is connected to the data line, and a first terminal thereof is connected to the power source line; a gate of the second transistor is connected to the first scan line, and a first terminal thereof is connected to a second terminal of the first transistor; the memory circuit is connected to a second terminal of the second transistor and the second scan line; a first terminal of the third transistor is connected to the light-emitting element; and the memory circuit holds a first potential inputted from the power source line or a second potential inputted from the second scan line, and applies the first potential or the second potential to a gate of the third transistor to control emission/non-emission of the light-emitting element.

One aspect of a semiconductor device of the invention includes a data line, a power source line, a first scan line, a second scan line, a first transistor, a second transistor, a memory circuit, and a third transistor. A gate of the first transistor is connected to the data line, and a first terminal thereof is connected to the power source line; a gate of the second transistor is connected to the first scan line, and a first terminal thereof is connected to a second terminal of the first transistor; the memory circuit is connected to a second terminal of the second transistor and the second scan line; and the memory circuit holds a first potential inputted from the power source line or a second potential inputted from the second scan line, and applies the first potential or the second potential to a gate of the third transistor to control on/off of the third transistor.

One aspect of a semiconductor device of the invention includes a data line, a first power source line, a second power source line, a first scan line, a second scan line, a first transistor, a second transistor, a memory circuit, a third transistor, and a light-emitting element. A gate of the first transistor is connected to the data line, and a first terminal thereof is connected to the first power source line; a gate of the second transistor is connected to the first scan line, and a first terminal thereof is connected to a second terminal of the first transistor; the memory circuit is connected to a second terminal of the second transistor and the second scan line; a gate of the third transistor is connected to the memory circuit, a first terminal thereof is connected to the second power source line, and a second terminal thereof is connected to the light-emitting element; and the memory circuit holds a first potential inputted from the first power source line or a second potential inputted from the second scan line, and applies the first potential or the second potential to the gate of the third transistor to control emission/non-emission of the light-emitting element.

One aspect of a semiconductor device of the invention includes a data line, a first power source line, a second power source line, a first scan line, a second scan line, a first transistor, a second transistor, a memory circuit, and a third transistor. A gate of the first transistor is connected to the data line, and a first terminal thereof is connected to the first power source line; a gate of the second transistor is connected to the first scan line, and a first terminal thereof is connected to a second terminal of the first transistor; the memory circuit is connected to a second terminal of the second transistor and the second scan line; a gate of the third transistor is connected to the memory circuit, and a first terminal thereof is connected to the second power source line; and the memory circuit holds a first potential inputted from the first power source line or a second potential inputted from the second scan line, and applies the first potential or the second potential to the gate of the third transistor to control on/off of the third transistor.

One aspect of a semiconductor device of the invention includes a data line, a power source line, a first scan line, a second scan line, a first transistor, a second transistor, a memory circuit, a third transistor, and a light-emitting element. A gate of the first transistor is connected to the data line, and a first terminal thereof is connected to the power source line; a gate of the second transistor is connected to the first scan line, and a first terminal thereof is connected to a second terminal of the first transistor; the memory circuit is connected to a second terminal of the second transistor and the second scan line; a first terminal of the third transistor is connected to the light-emitting element; and the memory circuit holds a first potential inputted from the power source line through the first transistor and the second transistor, or a second potential inputted from the second scan line, and applies the first potential or the second potential to a gate of the third transistor to control emission/non-emission of the light-emitting element.

One aspect of a semiconductor device of the invention includes a data line, a power source line, a first scan line, a second scan line, a first transistor, a second transistor, a memory circuit, and a third transistor. A gate of the first transistor is connected to the data line, and a first terminal thereof is connected to the power source line; a gate of the second transistor is connected to the first scan line, and a first terminal thereof is connected to a second terminal of the first transistor; the memory circuit is connected to a second terminal of the second transistor and the second scan line; and the memory circuit holds a first potential inputted from the power source line through the first transistor and the second transistor, or a second potential inputted from the second scan line, and applies the first potential or the second potential to a gate of the third transistor to control on/off of the third transistor.

One aspect of a semiconductor device of the invention includes a data line, a first power source line, a second power source line, a first scan line, a second scan line, a first transistor, a second transistor, a memory circuit, a third transistor, and a light-emitting element. A gate of the first transistor is connected to the data line, and a first terminal thereof is connected to the first power source line; a gate of the second transistor is connected to the first scan line, and a first terminal thereof is connected to a second terminal of the first transistor; the memory circuit is connected to a second terminal of the second transistor and the second scan line; a gate of the third transistor is connected to the memory circuit, a first terminal thereof is connected to the second power source line, and a second terminal thereof is connected to the light-emitting element; and the memory circuit holds a first potential inputted from the first power source line through the first transistor and the second transistor, or a second potential inputted from the second scan line, and applies the first potential or the second potential to the gate of the third transistor to control emission/non-emission of the light-emitting element.

One aspect of a semiconductor device of the invention includes a data line, a first power source line, a second power source line, a first scan line, a second scan line, a first transistor, a second transistor, a memory circuit, and a third transistor. A gate of the first transistor is connected to the data line, and a first terminal thereof is connected to the first power source line; a gate of the second transistor is connected to the first scan line, and a first terminal thereof is connected to a second terminal of the first transistor; the memory circuit is connected to a second terminal of the second transistor and the second scan line; a gate of the third transistor is connected to the memory circuit, and a first terminal thereof is connected to the second power source line; and the memory circuit holds a first potential inputted from the first power source line through the first transistor and the second transistor, or a second potential inputted from the second scan line, and applies the first potential or the second potential to a gate of the third transistor to control on/off of the third transistor.

One aspect of a semiconductor device of the invention includes a data line, a first power source line, a second power source line, a first scan line, a second scan line, a first n-channel transistor, a second n-channel transistor, an inverter circuit, a third n-channel transistor, a first p-channel transistor, a second p-channel transistor, a third p-channel transistor, and a light-emitting element. A gate of the first n-channel transistor is connected to the data line, and a first terminal thereof is connected to the first power source line; a gate of the second n-channel transistor is connected to the first scan line, and a first terminal thereof is connected to a second terminal of the first transistor; an input terminal of the inverter circuit is connected to a second terminal of the second n-channel transistor; a gate of the third n-channel transistor is connected to an output terminal of the inverter circuit, and a first terminal thereof is connected to the second scan line; a gate of the first p-channel transistor is connected to the first scan line, and a first terminal thereof is connected to the second power source line; a gate of the second p-channel transistor is connected to the output terminal of the inverter circuit, and a first terminal thereof is connected to a second terminal of the first p-channel transistor; a gate of the third p-channel transistor is connected to a second terminal of the second n-channel transistor, the input terminal of the inverter circuit, a second terminal of the third n-channel transistor, and a second terminal of the second p-channel transistor, a first terminal thereof is connected to the second power source line; and a second terminal thereof is connected to the light-emitting element.

One aspect of a semiconductor device of the invention includes a data line, a first power source line, a second power source line, a first scan line, a second scan line, a first n-channel transistor, a second n-channel transistor, an inverter circuit, a third n-channel transistor, a first p-channel transistor, a second p-channel transistor, and a third p-channel transistor. A gate of the first n-channel transistor is connected to the data line, and a first terminal thereof is connected to the first power source line; a gate of the second n-channel transistor is connected to the first scan line, and a first terminal thereof is connected to a second terminal of the first transistor, an input terminal of the inverter circuit is connected to a second terminal of the second n-channel transistor; a gate of the third n-channel transistor is connected to an output terminal of the inverter circuit, and a first terminal thereof is connected to the second scan line; a gate of the first p-channel transistor is connected to the first scan line, and a first terminal thereof is connected to the second power source line; a gate of the second p-channel transistor is connected to the output terminal of the inverter circuit, and a first terminal thereof is connected to a second terminal of the first p-channel transistor; and a gate of the third p-channel transistor is connected to a second terminal of the second n-channel transistor, the input terminal of the inverter circuit, a second terminal of the third n-channel transistor, and a second terminal of the second p-channel transistor, and a first terminal thereof is connected to the second power source line.

A potential of the first power source line of the invention may be lower than a potential of the second power source line.

A potential of the second power source line of the invention may be higher than a potential inputted to the data line.

In the invention, a capacitor may be additionally provided, one electrode of which is connected to the gate of the third p-channel transistor and the other electrode of which is connected to the second power source line.

The light-emitting element of the invention may be a display medium, a contrast of which changes by an electromagnetic function such as an EL element (e.g., an organic EL element, an inorganic EL element, or an EL element containing an organic material and an inorganic material) or a plasma display (PDP). Note that as a display device using such an EL element, there is an EL display.

In addition, the invention provides an electronic apparatus such as a television receiver, a camera (e.g., video camera or a digital camera), a goggle display, a navigation system, an audio reproducing device, a computer, a game machine, a mobile computer, a portable phone, a portable game machine, an electronic book, or an image reproducing device.

In the semiconductor device having a light-emitting element in accordance with the invention, a constant potential is continuously supplied to a gate electrode of a driving transistor regardless of whether the light-emitting element is in the emission state or non-emission state. Therefore, stable operation can be performed unlike the conventional pixel configuration where a potential is held in a holding capacitor.

Further, in the semiconductor device of the invention, on/off potentials applied to a gate electrode of a driving transistor can be set separately from a potential of a data line. Accordingly, the potential amplitude of the data line can be set small, and thus a semiconductor device with a significantly suppressed power consumption can be provided.

Further, in the semiconductor device of the invention, even when a signal supply is stopped to a memory circuit in each pixel of the pixel portion from a scan line driver circuit and a data line driver circuit that are disposed on the periphery of the pixel portion, signal data that has been supplied until immediately before the signal supply is stopped can be held; therefore, a light-emitting element can hold the emission state or non-emission state even under the aforementioned circumstance.

In addition, by applying the invention to a display device, a potential for selecting a light-emitting element to be in the emission state or non-emission state is continuously and stably supplied to a gate electrode of a driving transistor. Therefore, stable display operation can be performed unlike the conventional pixel configuration where a potential is held in a holding capacitor.

Further, in the display device of the invention, on/off potentials applied to a gate electrode of a driving transistor can be set separately from a potential of a data line. Accordingly, the potential amplitude of the data line can be set small, and thus a display device with a significantly suppressed power consumption can be provided.

Further, in the display device of the invention, even when a signal supply is stopped to a memory circuit in each pixel of the pixel portion from a scan line driver circuit and a data line driver circuit that are disposed on the periphery of the pixel portion, signal data that has been supplied until immediately before the signal supply is stopped can be held; therefore, a light-emitting element can hold the emission state or non-emission state even under the aforementioned circumstance.

Further, in an electronic apparatus using the semiconductor device of the invention, a constant potential is continuously supplied to a gate electrode of a driving transistor regardless of whether a light-emitting element is in the emission state or non-emission state. Therefore, stable display operation can be performed unlike the conventional pixel configuration where a potential is held in a holding capacitor. Thus, products with stable display operation can be manufactured to provide less defective goods to customers.

Further, in the electronic apparatus of the invention, on/off potentials applied to a gate electrode of a driving transistor can be set separately from a potential of a data line. Accordingly, the potential amplitude of the data line can be set small, and thus an electronic apparatus with a significantly suppressed power consumption can be provided.

Further, in the electronic apparatus having the display device of the invention, even when a signal supply is stopped to a memory circuit in each pixel of a pixel portion from a scan line driver circuit and a data line driver circuit that are disposed on the periphery of the pixel portion, signal data that has been supplied until immediately before the signal supply is stopped can be held; therefore, a light-emitting element can hold the emission state or non-emission state to display images even under the aforementioned circumstance.

DETAILED DESCRIPTION OF THE INVENTION

Embodiment Mode

Figure 1:
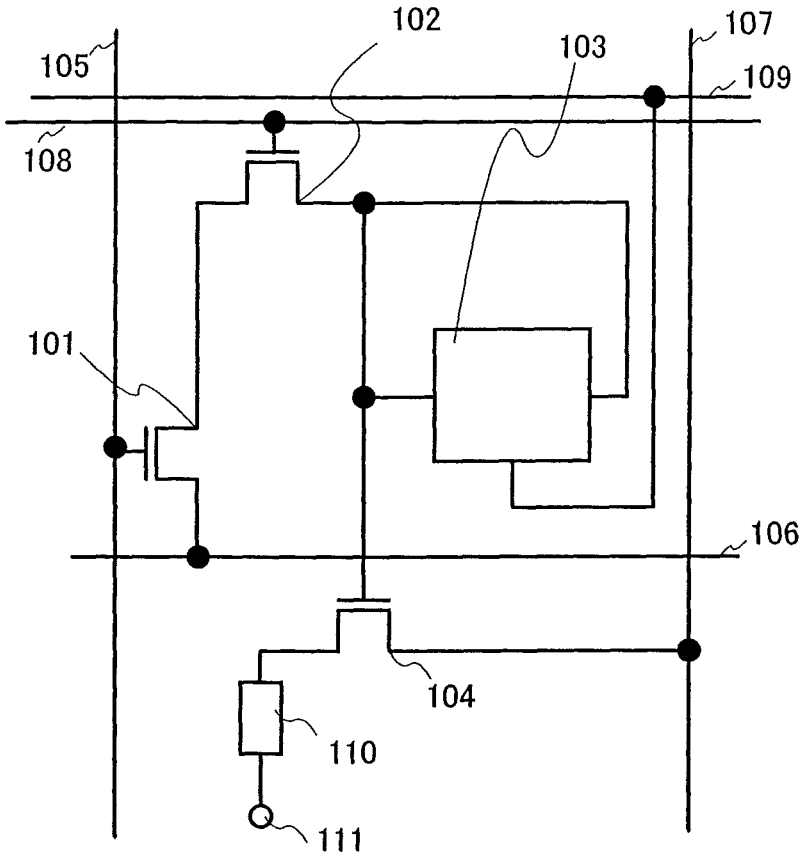
FIG. 1 shows a circuit diagram in accordance with an embodiment mode of the invention.

Although the invention will be fully described by way of an embodiment mode and embodiments with reference to the accompanying drawings, it is to be understood that various changes and modifications will be apparent to those skilled in the art. Therefore, unless otherwise such changes and modifications depart from the scope of the invention, they should be construed as being included therein. Note that common portions or portions having a common function are denoted by the identical reference numerals in all the drawings, and therefore, description thereon will be made only once.

First, description is made on a pixel configuration of a semiconductor device of the invention, and the operation principle thereof.

FIG. 1 shows a pixel configuration of the invention. Although only one pixel is shown here, the pixel portion of the semiconductor device actually has multiple pixels that are arranged in matrix of rows and columns.

The pixel has a data transistor 101 (also referred to as a first transistor), a switch transistor 102 (also referred to as a second transistor), a memory circuit 103, a driving transistor 104 (also referred to as a third transistor), a data line 105, a first power source line 106, a second power source line 107, a first scan line 108, a second scan line 109, a light-emitting element 110, and a counter electrode 111.

Note that in the invention, a pixel means one picture element, the luminance of which can be controlled. For example, one pixel shows one color element for expressing luminance. Thus, in the case of a color display device composed of color elements of R (Red), G (Green) and B (Blue), the minimum unit of an image is composed of three pixels of an R pixel, a G pixel and a B pixel. Note that the color element is not limited to the three colors, and more colors may be used. For example, RGBW (W means white) may be employed.

A first terminal (one of source and drain terminals) of the data transistor 101 is connected to the first power source line 106, a gate terminal thereof is connected to the data line 105, and a second terminal (the other of the source and drain terminals) thereof is connected to a first terminal (one of source and drain terminals) of the switch transistor 102. In addition, the first terminal (one of the source and drain terminals) of the switch transistor 102 is connected to the second terminal of the data transistor 101, a gate terminal thereof is connected to the first scan line 108, and a second terminal (the other of the source and drain terminals) thereof is connected to input and output terminals of the memory circuit 103 and a gate terminal of the driving transistor 104. In addition, the memory circuit 103 is connected to the gate terminal of the driving transistor 104, the second terminal of the switch transistor 102 and the second scan line 109. A first terminal (one of source and drain terminals) of the driving transistor 104 is connected to the second power source line 107, the gate terminal thereof is connected to the input and output terminals of the memory circuit 103 and the second terminal of the switch transistor 102, and a second terminal (the other of the source and drain terminals) thereof is connected to one electrode of the light-emitting element 110. In addition, the other electrode of the light-emitting element 110 is connected to the counter electrode 111.

Note that in the invention, connection means/includes electrical connection. Therefore, in the disclosed structure of the invention, other elements (e.g., switch, transistor, capacitor, inductor, resistor, or diode) may be added between a predetermined connection as long as it enables electrical connection.

Note that the first power source line 106 is set at a potential Vc that is lower than the second power source line 107. That is, $Vc<Vdd$ is satisfied, where Vdd is a standard potential set to the second power source line 107 during the emission period of the pixel. That is, $|Vth|<|Vgs|$ is satisfied, where $|Vgs|$ is the absolute value of the gate-source voltage of the driving transistor 104, and $|Vth|$ is the absolute value of the threshold voltage of the driving transistor 104. For example, Vc may be equal to GND (ground potential).

Note that various types of transistors may be used as the transistor in the invention. Therefore, the invention is not limited to a certain type of transistors. A transistor used in the invention may be a thin film transistor (TFT) using a non-single crystalline semiconductor film typified by amorphous silicon or polycrystalline silicon, a MOS transistor formed by using a semiconductor substrate or an SOI substrate, a junction transistor, a bipolar transistor, a transistor using a compound semiconductor such as ZnO or a-InGaZnO, a transistor using an organic semiconductor or a carbon nanotube, or other transistors. In addition, a substrate over which transistors are formed is not limited to a certain type, and various kinds of substrates can be used. Accordingly, transistors can be formed over a single crystalline substrate, an SOI substrate, a glass substrate, a plastic substrate, a paper substrate, a cellophane substrate, a quartz substrate or the like. Alternatively, after forming transistors over a substrate, the transistors may be transposed onto another substrate.

Note that the first terminal of the data transistor 101 may be connected anywhere as long as it is connected to a wire set at the potential Vc that is lower than the second power source line 107 during the period when the data transistor 101 is on. For example, such a configuration may be provided that a second scan line 109 that is provided in the adjacent pixel is set at the potential of Vc in the period when the data transistor 101 is on, so that the potential of Vc may be supplied to the pixel from the second scan line 107.

Note that the counter electrode (cathode) 111 of the light-emitting element 110 is set at a potential Vss lower than the second power source line 107. That is, Vss<Vdd is satisfied, where Vdd is a standard potential set to the second power source line 107 during the emission period of the pixel. For example, Vss may be equal to GND (ground potential). In addition, the first power source line 106 and the counter electrode 111 may be set to have the same potential of GND.

Note that a signal inputted to the driving transistor 104 for turning the light-emitting element 110 into the emission state is called a first signal, while a signal inputted to the driving transistor 104 for turning the light-emitting element 110 into the non-emission state is called a second signal.

Next, description is made with reference to FIG. 2A to 4B on the operation method of the pixel configuration shown in FIG. 1.

Note that in the description along with FIG. 2A to 4B, an n-channel transistor is used for the data transistor 101, an n-channel transistor is used for the switch transistor 102, and a p-channel transistor is used for the driving transistor 104. Note that the polarity of the transistors is not specifically limited as long as such transistors can perform the same operation as each transistor of the invention even when changing a potential of a wire connected to a terminal of each transistor. In addition, when changing the direction of a current flowing in the light-emitting element, the potentials of the second power source line and the counter electrode may be appropriately set similarly to the case of changing the polarity of each transistor as described above.

Figure 2A:
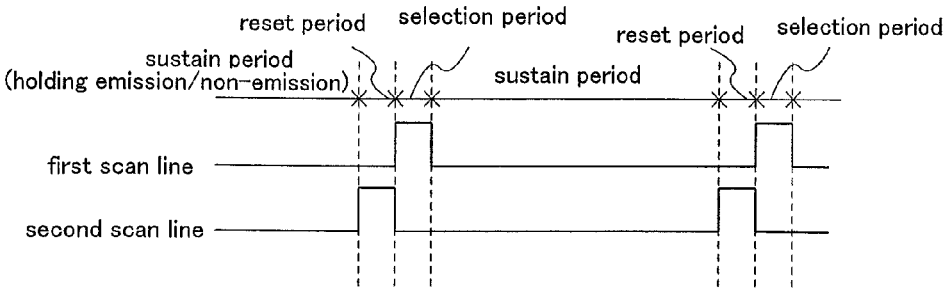
FIG. 2A and FIG. 2B show one embodiment mode of the invention.

First, FIG. 2A shows a timing chart of potentials at the first scan line and the second scan line in the pixel configuration of the invention. In the pixel configuration of the invention, an emission state or non-emission state of each pixel is selected by providing a reset period, a selection period and a sustain period.

In the pixel configuration of the invention, signals for controlling on/off of the driving transistor, which have conventionally been inputted from a data line, are not inputted. Therefore, it is required that a reset signal (a signal for turning a light-emitting element into the non-emission state) be inputted into the memory circuit in the pixel in advance. Such a period when a reset signal is inputted into the memory circuit in the pixel in advance is called a reset period in this specification.

Although FIG. 2A shows an example where the operations in the reset period and the selection period are continuously performed, a time margin is preferably provided between the reset period and the selection period. By providing the time margin between the reset period and the selection period, a potential from a data line can be inputted into the pixel without malfunctions.

Figure 2B:
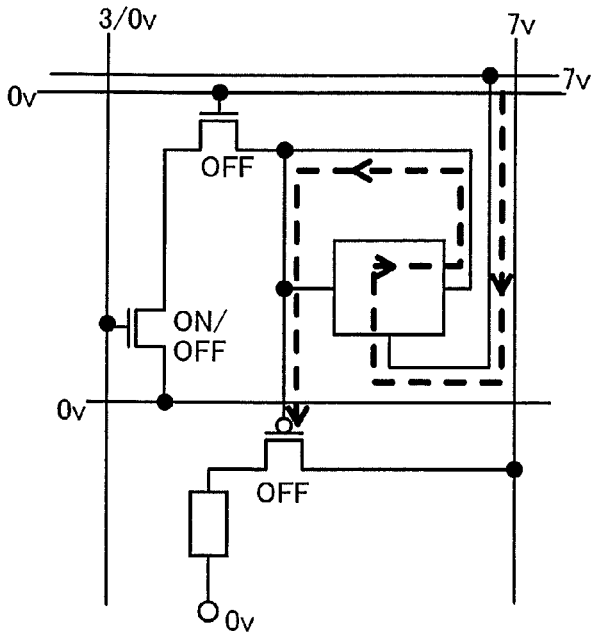

FIG. 2B shows on/off of each transistor and a potential of each wire in the reset period in the pixel configuration shown in FIG. 1. Note that dashed arrows schematically show the input path of a potential that is inputted for selecting emission/non-emission of the light-emitting element. A specific potential value of each power source line is set as follows: a potential of the data line is 3 V or 0 V (hereinafter, 3/0 V), a potential of the first power source line is GND (hereinafter, 0 V), a potential of the second power source line is 7 V, a potential of the counter electrode of the light-emitting element is 0 V, a potential of the first scan line is an L potential (here, 0 V), and a potential of the second scan line is an H potential (here, 7 V). Note that the specific potential value of each wire shown herein is only an example; therefore, the invention is not limited to this. The potential of each wire is only required to be a potential that enables on/off operation of each transistor.

In FIG. 2B, an H potential from the second scan line is inputted into the memory circuit, and then applied to the gate terminal of the driving transistor that is connected to the memory circuit. Then, the driving transistor is turned off, and the light-emitting is turned into the non-emission state. Thus, an H potential as a reset signal is held in the memory circuit.

In this reset period, the first scan line is at an L potential and the switch transistor is off; therefore, even when the potential of the data line changes to turn on/off the data transistor, neither potential of the memory circuit nor the gate terminal of the driving transistor changes.

Note that the potential of the gate terminal of the driving transistor in the reset period is held in the memory circuit. Accordingly, unlike a pixel configuration using a holding capacitor, there are few problems concerning malfunctions of the driving transistor that would be caused when a potential applied to the gate electrode of the driving transistor fluctuates due to the effect of noise, a leakage potential from the switch transistor and the like.

Figure 3A:
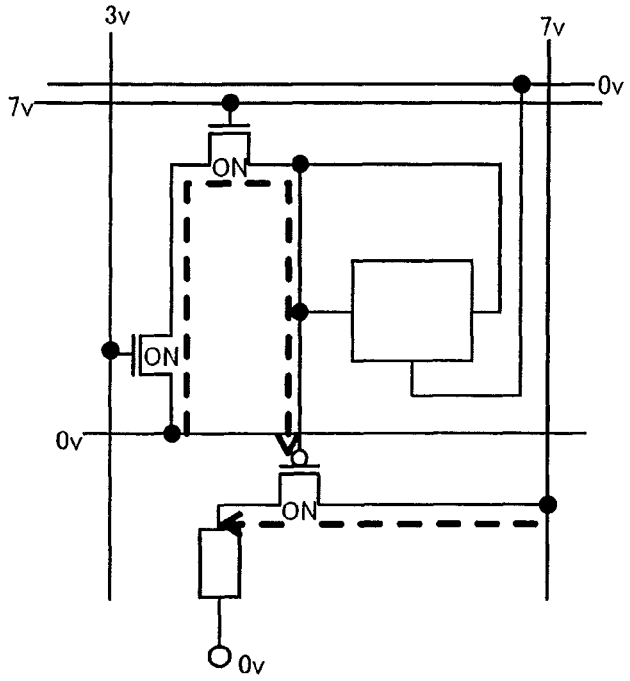
FIG. 3A and FIG. 3B show one embodiment mode of the invention.

FIG. 3A shows on/off of each transistor and a potential of each wire in the case where the light-emitting element is selected to be in the emission state in the selection period in the pixel configuration shown in FIG. 1. Note that dashed arrows schematically show the input path of a potential that is inputted for selecting emission/non-emission of the light-emitting element. A specific potential value of each power source line is set as follows: a potential of the data line is an H potential (here, 3 V), a potential of the first power source line is 0 V, a potential of the second power source line is 7 V, a potential of the counter electrode of the light-emitting element is 0 V, a potential of the first scan line is an H potential (here, 7 V), and a potential of the second scan line is an L potential (here, 0 V). Note that the specific potential value of each wire shown herein is only an example; therefore, the invention is not limited to this. The potential of each wire is only required to be a potential that enables on/off operation of each transistor.

In FIG. 3A, the H potential inputted to the data line is inputted to the gate terminal of the data transistor, thereby the data transistor is turned on. The switch transistor is turned on by the H potential inputted to the first scan line. Then, the potential of the first power source line is inputted to the gate terminal of the driving transistor and the memory circuit. At this time, the driving transistor is turned on by a potential difference applied between the gate and source of the driving transistor. Then, the second power source line is electrically connected to the light-emitting element, and a voltage is applied to the opposite electrodes of the light-emitting element. Thus, a current flows into the light-emitting element, and the light-emitting element emits light.

Figure 3B:
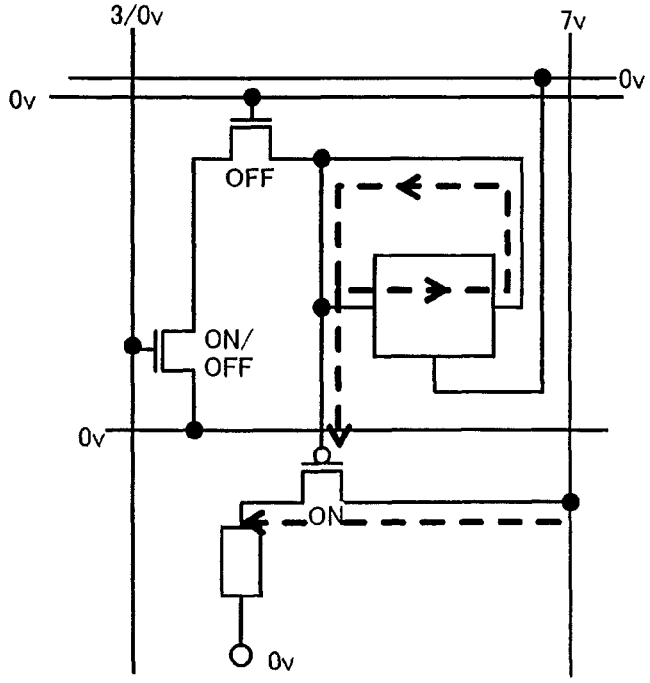

FIG. 3B shows on/off of each transistor and a potential of each wire in the case where the light-emitting element is controlled to hold the emission state in the sustain period in the pixel configuration shown in FIG. 1. Note that dashed arrows schematically show the input path of a potential that is inputted for selecting emission/non-emission of the light-emitting element. A specific potential value of each power source line is set as follows: a potential of the data line is 3/0 V, a potential of the first power source line is 0 V, a potential of the second power source line is 7 V, a potential of the counter electrode of the light-emitting element is 0 V, a potential of the first scan line is an L potential (here, 0 V), and a potential of the second scan line is an L potential (here, 0 V). Note that the specific potential value of each wire shown herein is only an example; therefore, the invention is not limited to this. The potential of each wire is only required to be a potential that enables on/off operation of each transistor.

In FIG. 3B, a potential inputted from the first power source line to be applied to the gate terminal of the driving transistor in the aforementioned selection period is held in the memory circuit, and thus it continues to be applied to the gate terminal of the driving transistor. At this time, the driving transistor is turned on by a potential difference applied between the gate and source of the driving transistor. Then, the second power source line is electrically connected to the light-emitting element, and a voltage is applied to the opposite electrodes of the light-emitting element. Thus, a current flows into the light-emitting element, and the light-emitting element holds the emission state.

In this holding period, the first scan line is at an L potential and the switch transistor is off; therefore, even when the potential of the data line changes to turn on/off the data transistor, neither potential of the memory circuit nor the gate terminal of the driving transistor changes.

Figure 4A:
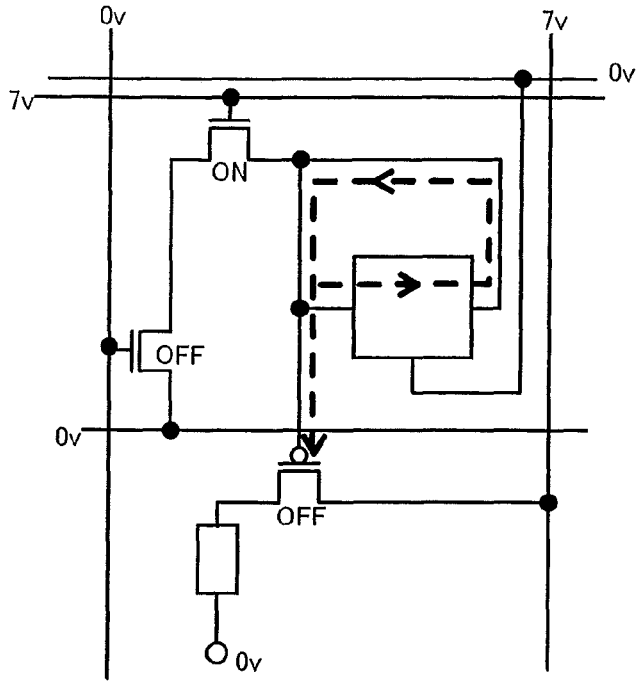
FIG. 4A and FIG. 4B show one embodiment mode of the invention.

FIG. 4A shows on/off of each transistor and a potential of each wire in the case Where the light-emitting element is selected to be in the non-emission state in the selection period in the pixel configuration shown in FIG. 1. Note that dashed arrows schematically show the input path of a potential that is inputted for selecting emission/non-emission of the light-emitting element. A specific potential value of each power source line is set as follows: a potential of the data line is an L potential (here, 0 V), a potential of the first power source line is 0 V, a potential of the second power source line is 7 V, a potential of the counter electrode of the light-emitting element is 0 V, a potential of the first scan line is an H potential (here, 7 V), and a potential of the second scan line is an L potential (here, 0 V). Note that the specific potential value of each wire shown herein is only an example; therefore, the invention is not limited to this. The potential of each wire is only required to be a potential that enables on/off operation of each transistor.

In FIG. 4A, the L potential inputted to the data line is inputted to the gate terminal of the data transistor, thereby the data transistor is turned off. The switch transistor is turned on by the H potential inputted to the first scan line. Therefore, a potential of the first power source line is not inputted to the gate terminal of the driving transistor nor the memory circuit, but the H potential as a reset signal that has been inputted into the memory circuit during the aforementioned reset period continues to be applied to the gate terminal of the driving transistor. At this time, the absolute value of the potential difference applied between the gate and source of the driving transistor becomes lower than the absolute value of the threshold voltage of the driving transistor, and thus the driving transistor is turned off. Thus, the second power source line is not electrically connected to the light-emitting element, and no current flows into the light-emitting element. Thus, the light-emitting element is turned into the non-emission state.

Figure 4B:
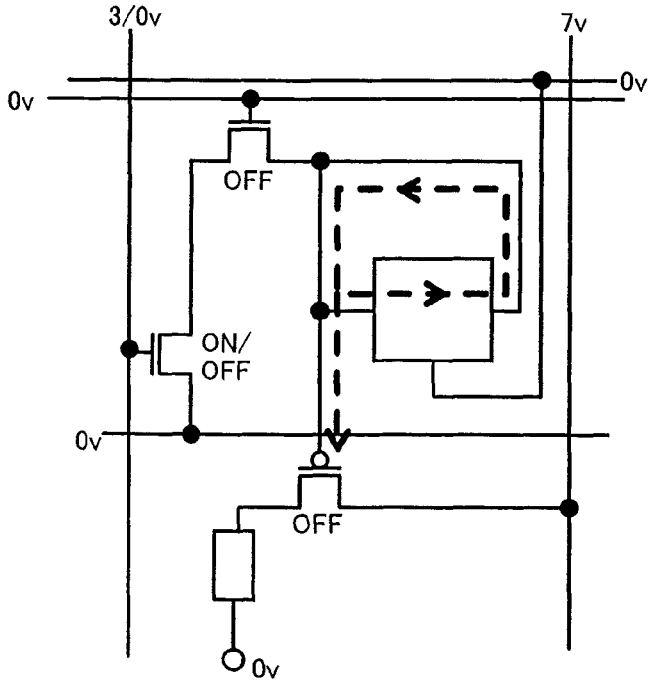

FIG. 4B shows on/off of each transistor and a potential of each wire in the case where the light-emitting element is controlled to hold the non-emission state in the sustain period in the pixel configuration shown in FIG. 1. Note that dashed arrows schematically show the input path of a potential that is inputted for selecting emission/non-emission of the light-emitting element. A specific potential value of each power source line is set as follows: a potential of the data line is 3/0 V, a potential of the first power source line is 0 V, a potential of the second power source line is 7 V, a potential of the counter electrode of the light-emitting element is 0 V, a potential of the first scan line is an L potential (here, 0 V), and a potential of the second scan line is an L potential (here, 0 V). Note that the specific potential value of each wire shown herein is only an example; therefore, the invention is not limited to this. The potential of each wire is only required to be a potential that enables on/off operation of each transistor.

In FIG. 4B, the H potential as a reset signal that has been inputted into the memory circuit in the aforementioned selection period is held in the memory circuit, and thus it continues to be applied to the gate terminal of the driving transistor. At this time, the absolute value of the potential difference applied between the gate and source of the driving transistor becomes lower than the absolute value of the threshold voltage of the driving transistor, and thus the driving transistor is turned off. Thus, the second power source line is not electrically connected to the light-emitting element, and no current flows into the light-emitting element. Thus, the light-emitting element holds the non-emission state.

In this holding period, the first scan line is at an L potential and the switch transistor is off; therefore, even when the potential of the data line changes to turn on/off the data transistor, neither potential of the memory circuit nor the gate terminal of the driving transistor changes.

Note that the potential of the gate terminal of the driving transistor in the holding period is held in the memory circuit. Accordingly, unlike a pixel configuration using a holding capacitor, there are few problems concerning malfunctions of the driving transistor that would be caused when a potential applied to the gate electrode of the driving transistor fluctuates due to the effect of noise, a leakage potential from the switch transistor and the like.

Note that in the aforementioned holding period in which a light-emitting element holds the emission state or non-emission state, even when a signal supply is stopped to the memory circuit in each pixel of the pixel portion from a scan line driver circuit and a data line driver circuit that are disposed on the periphery of the pixel portion, signal data that has been supplied until immediately before the signal supply is stopped can be held; therefore, the light-emitting element can hold the emission state or non-emission state even under the aforementioned circumstance. Therefore, neither the scan line driver circuit nor the data line driver circuit is required to be operated for displaying still images or the like by using the semiconductor device of the invention, and thus a significant reduction in power consumption can be expected.

Figure 23:
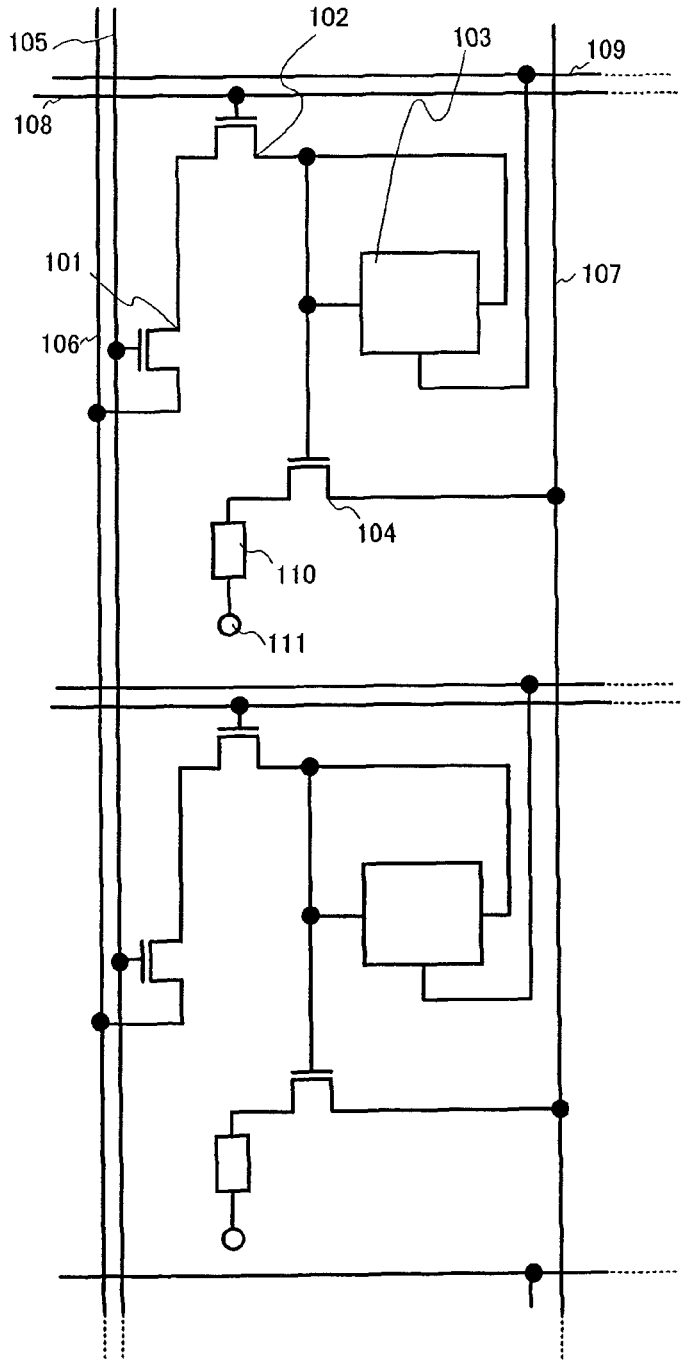
FIG. 23 shows one embodiment mode of the invention.

In addition, in the pixel configuration shown in FIG. 1 of this embodiment mode, the first power source line 106 may be disposed in parallel with the data line 105 and the second power source line 107 as shown in FIG. 23. By disposing the first power source line 106 in parallel with the data line 105 and the second power source line 107 as shown in FIG. 23, power is not supplied to multiple columns in the case of performing a line sequential drive. Therefore, the configuration of FIG. 23 can suppress a voltage drop due to the wiring resistance or the like in comparison with the case where the first power source line 106 is disposed in parallel with the first scan line 108 and the second scan line 109. Thus, the original design can have a narrow line width.

Note that this embodiment mode can be freely implemented in combination with any of the other embodiments in this specification.

EMBODIMENTS

Description is made below on embodiments of the invention.

Embodiment 1

In this embodiment, description is made on a specific pixel configuration of a semiconductor device of the invention, and the operation principle thereof.

Figure 5:
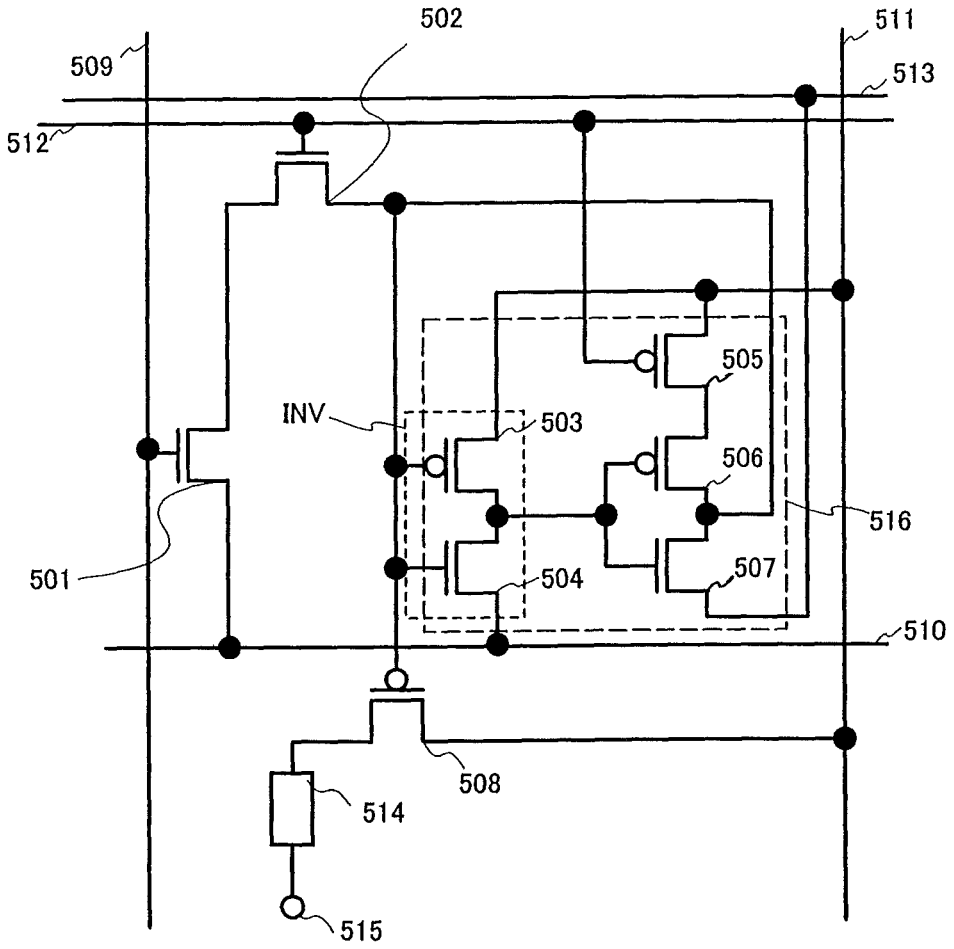
FIG. 5 shows a circuit diagram in accordance with Embodiment 1 of the invention.

First, description is made in detail with reference to FIG. 5 on a pixel configuration of a semiconductor device of the invention. Although only one pixel is shown here, the pixel portion of the semiconductor device actually has multiple pixels that are arranged in matrix of rows and columns.

The pixel includes a data transistor 501, a switch transistor 502, an inverter circuit INV having a selection transistor 503 and a selection transistor 504, a holding transistor 505, a holding transistor 506, a holding transistor 507, a driving transistor 508, a data line 509, a first power source line 510, a second power source line 511, a first scan line 512, a second scan line 513, a light-emitting element 514, and a counter electrode 515. In this embodiment, the inverter circuit INV, the holding transistor 505, the holding transistor 506, and the holding transistor 507 are collectively referred to as a memory circuit 516. Note that the data transistor 501 is an n-channel transistor, the switch transistor 502 is an n-channel transistor, the holding transistor 505 and the holding transistor 506 are p-channel transistors, the holding transistor 507 is an n-channel transistor, and the driving transistor 508 is a p-channel transistor. Note that the polarity of these transistors is not specifically limited as long as they can perform the same operation as the respective transistors of the invention even when changing a potential of a wire connected to a terminal of each transistor.

A first terminal (one of source and drain terminals) of the data transistor 501 is connected to the first power source line 510, a gate terminal thereof is connected to the data line 509, and a second terminal (the other of the source and drain terminals) thereof is connected to a first terminal (one of source and drain terminals) of the switch transistor 502. In addition, the first terminal (one of the source and drain terminals) of the switch transistor 502 is connected to the second terminal of the data transistor 501, a gate terminal thereof is connected to the first scan line 512, and a second terminal (the other of the source and drain terminals) thereof is connected to gate terminals of the selection transistors 503 and 504 that correspond to an input terminal of the inverter circuit INV and a gate terminal of the driving transistor 508. The input terminal of the inverter circuit INV is connected to the second terminal (the other of the source and drain terminals) of the switch transistor 502 and the gate terminal of the driving transistor 508, and an output terminal thereof is connected to gate terminals of the holding transistors 506 and 507. A first terminal (one of source and drain terminals) of the selection transistor 503 is connected to the second power source line 511, and a second terminal (the other of the source and drain terminals) thereof is connected to a first terminal (one of source and drain terminals) of the selection transistor 504. The first terminal (one of the source and drain terminals) of the selection transistor 504 is connected to the second terminal of the selection transistor 503, and a second terminal (the other of the source and drain terminals) thereof is connected to the first power source line 510. A first terminal (one of source and drain terminals) of the holding transistor 505 is connected to the second power source line 511, a gate terminal thereof is connected to the first scan line 512, and a second terminal (the other of the source and drain terminals) thereof is connected to a first terminal (one of source and drain terminals) of the holding transistor 506. The first terminal (one of the source and drain terminals) of the holding transistor 506 is connected to the second terminal of the holding transistor 505, a gate terminal of the holding transistor 506 is connected to an output terminal of the inverter circuit INV, and a second terminal (the other of the source and drain terminals) thereof is connected to a first terminal (one of source and drain terminals) of the holding transistor 507. The first terminal (one of the source and drain terminals) of the holding transistor 507 is connected to the second terminal of the holding transistor 506, a gate terminal thereof is connected to the output terminal of the inverter circuit INV, and a second terminal (the other of the source and drain terminals) thereof is connected to the second scan line 513. A first terminal (one of source and drain terminals) of the driving transistor 508 is connected to the second power source line 511, the gate terminal thereof is connected to the input terminal of the inverter circuit INV, the second terminal of the switch transistor 502, the second terminal of the holding transistor 506, and the first terminal of the holding transistor 507, and a second terminal (the other of the source and drain terminals) of the driving transistor 508 is connected to one electrode of the light-emitting element 514. The other electrode of the light-emitting element 514 is connected to the counter electrode 515.

Note that the first power source line 510 is set at a potential Vc that is lower than the second power source line 511. Note that Vc<Vdd is satisfied, where Vdd is a potential set to the second power source line 511 during the emission period of the pixel. That is, |Vth|<|Vgs| is satisfied, where |Vgs| is the absolute value of the gate-source voltage of the driving transistor 508, and |Vth| is the absolute value of the threshold voltage of the driving transistor 508. For example, Vc may be equal to GND (ground potential).

Note that the counter electrode (cathode) 515 of the light-emitting element 514 is set at a potential Vss that is lower than the second power source line 511. Note also that Vss<Vdd is satisfied, where Vdd is a potential set to the second power source line 511 during the emission period of the pixel. For example, Vss may be equal to GND (ground potential). In addition, the first power source line 510 and the counter electrode 515 may be set to have the same potential of GND.

Next, description is made with reference to FIG. 6A to 8B on the operation method of the pixel configuration shown in FIG. 5.

Figure 6A:
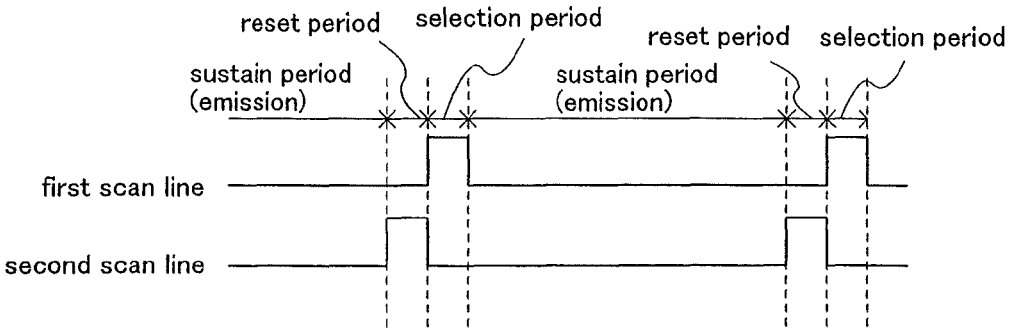
FIG. 6A and FIG. 6B show Embodiment 1 of the invention.
Figure 6B:
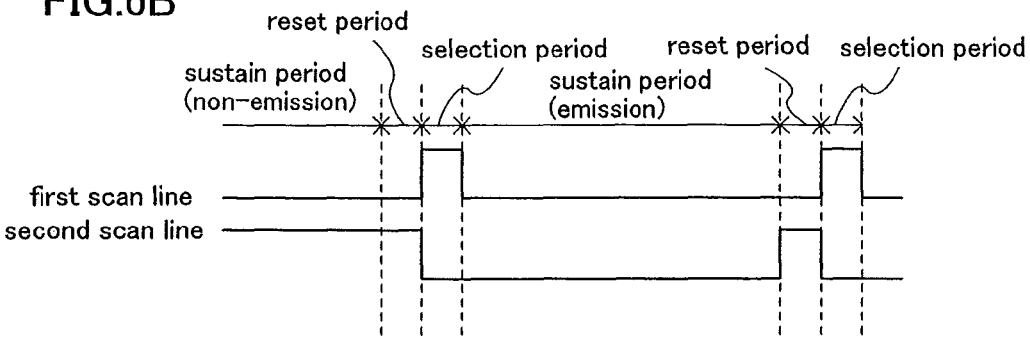

FIG. 6A and FIG. 6B show timing charts of potentials at the first scan line and the second scan line in the pixel configuration of the invention. In the pixel configuration of the invention, an emission state or non-emission state of each pixel is selected by providing a reset period, a selection period and a sustain period.

In the pixel configuration of the invention, signals for controlling on/off of the driving transistor, which have conventionally been inputted from a data line, are not inputted. Therefore, it is required that a reset signal (a signal for turning a light-emitting element into the non-emission state) be inputted into the memory circuit in the pixel in advance. Such a period when a reset signal is inputted into the memory circuit in the pixel in advance is called a reset period in this specification.

In FIG. 6A, in the case where a pixel has been in the emission state before the reset period, a reset signal is inputted into a memory circuit in the pixel from the second scan line in the reset period. In this embodiment, the driving transistor is a p-channel transistor; therefore, a reset signal is an H signal. Needless to say, a signal inputted from the second scan line may be an L signal depending on the polarity of the driving transistor. After the reset period, the light-emitting element in the pixel is selected to be in the emission state or non-emission state in the selection period in which an H signal is inputted to the first scan line, and thus the light-emitting element in the pixel emits light or not in accordance with a signal selected in the sustain period.

In the case where the pixel has been in the non-emission state before the reset period, a reset signal does not have to be inputted into the memory circuit in the pixel from the second scan line during the reset period, but also may be inputted continuously from the previous non-emission period in which the pixel has been in the non-emission state as shown in FIG. 6B.

Although FIG. 6A and FIG. 6B show examples where the operations in the reset period and the selection period are continuously performed, a time margin may be provided between the reset period and the selection period. By providing the time margin between the reset period and the selection period, a potential inputted from the data line can be inputted into the pixel without malfunctions.

Figure 7A:
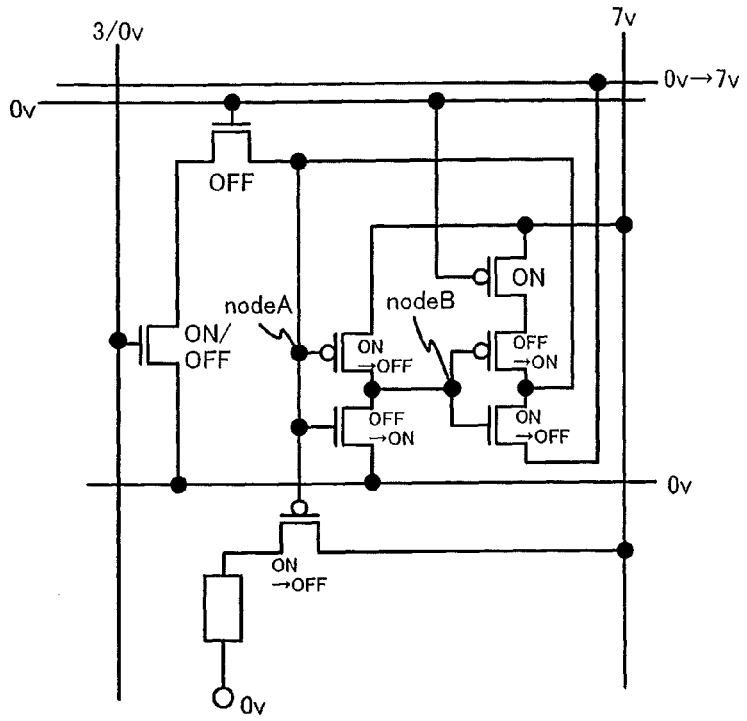
FIG. 7A and FIG. 7B show Embodiment 1 of the invention.
Figure 7B:
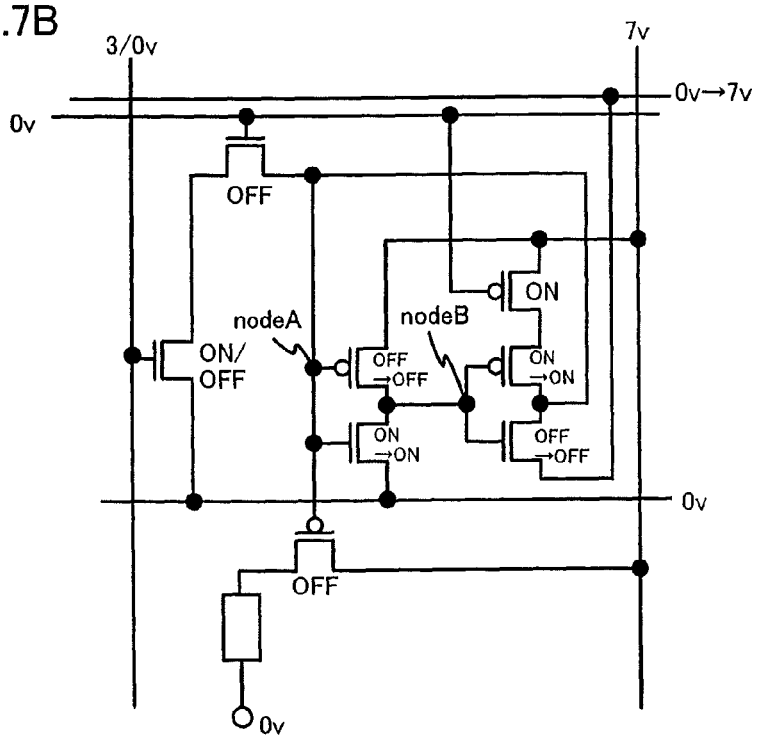

FIG. 7A and FIG. 7B schematically show the input path of a potential from the second scan line in the reset period in FIG. 6A and FIG. 6B. A specific potential value of each power source line is set as follows: a potential of the data line is 3/0 V, a potential of the first power source line is 0 V, a potential of the second power source line is 7 V, a potential of the counter electrode of the light-emitting element is 0 V, a potential of the first scan line is an L potential (here, 0 V), and a potential of the second scan line is an H potential (here, 7 V). Note that the specific potential value of each wire shown herein is only an example; therefore, the invention is not limited to this. The potential of each wire is only required to be a potential that enables on/off operation of each transistor.

FIG. 7A shows on/off switching of each transistor in the case where the pixel has been in the emission state in the sustain period before the reset period. In the emission state, an L potential is applied to the gate terminal of the driving transistor (e.g., a node A). Then, the driving transistor is turned on, and each transistor in the memory circuit is controlled to be turned on/off so as to hold the on state of the driving transistor, that is to hold the L potential.

In FIG. 7A, while the holding transistor 507 is on, an H potential from the second scan line is inputted to the second terminal of the holding transistor 507, thereby the node A is at an H potential. When the node A is at an H potential, an H potential is inputted to the input terminal of the inverter circuit INV, and an L potential is outputted to a node B. By the L potential at the node B, the holding transistor 506 is turned on and the holding transistor 507 is turned off. Then, the potential of the second power source line, namely an H potential is again supplied to the node A from the second terminal of the holding transistor 507 through the holding transistor 505, thus the potential of the node A is certainly fixed through the memory circuit 516.

FIG. 7B shows on/off switching of each transistor in the case where the pixel has been in the non-emission state in the sustain period before the reset period. In the non-emission state, an H potential is applied to the gate terminal of the driving transistor (e.g., a node A). Then, the driving transistor is turned off, and each transistor in the memory circuit is controlled to be turned on/off so as to hold the off state of the driving transistor, that is to hold the H potential.

The non-emission state in FIG. 7B satisfies the condition of potentials in the reset period in FIG. 7A; therefore, the reset period is not particularly required to be provided as described in FIG. 6B. Needless to say, an H potential may be inputted from the second scan line to the second terminal of the holding transistor 507 in the memory circuit. At this time, the light-emitting element is already in the non-emission state, and on/off of each transistor does not change. Thus, the memory circuit holds the H potential as a reset signal.

Figure 8A:
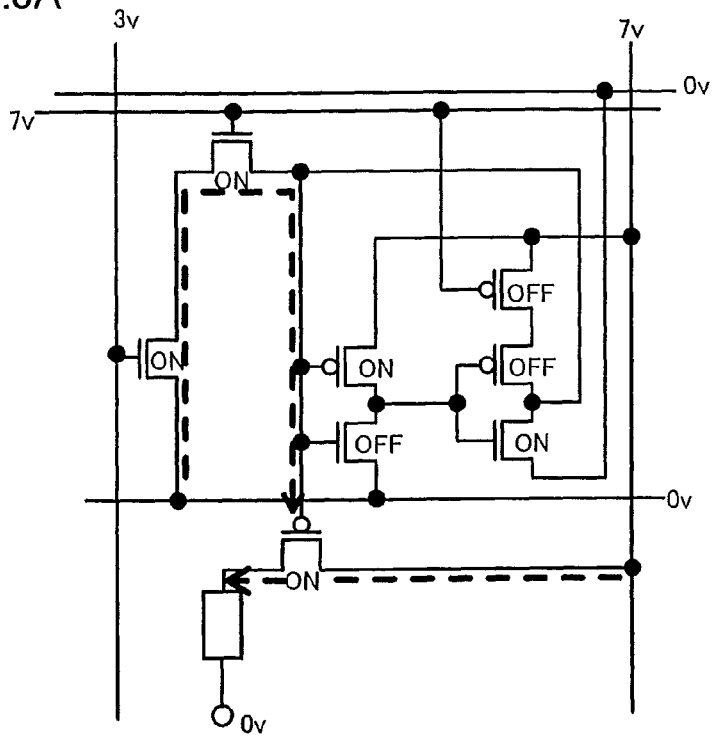
FIG. 8A and FIG. 8B show Embodiment 1 of the invention.

FIG. 8A shows on/off of each transistor and a potential of each wire in the case where the light-emitting element is selected to be in the emission state in the selection period in the pixel configuration shown in FIG. 5. Note that dashed arrows schematically show the input path of a potential that is inputted for selecting emission/non-emission of the light-emitting element. A specific potential value of each power source line is set as follows: a potential of the data line is an H potential (here, 3 V), a potential of the first power source line is 0 V, a potential of the second power source line is 7 V, a potential of the counter electrode of the light-emitting element is 0 V, a potential of the first scan line is an H potential (here, 7 V), and a potential of the second scan line is an L potential (here, 0 V). Note that the specific potential value of each wire shown herein is only an example; therefore, the invention is not limited to this. The potential of each wire is only required to be a potential that enables on/off operation of each transistor.

In FIG. 8A, the H potential inputted to the data line is inputted to the gate terminal of the data transistor, thereby the data transistor is turned on. The switch transistor is turned on by the H potential inputted to the first scan line. In addition, the potential of the first power source line is inputted to the gate terminal of the driving transistor and the memory circuit. At this time, the driving transistor is turned on by a potential difference applied between the gate and source of the driving transistor. Then, the second power source line is electrically connected to the light-emitting element, and a voltage is applied to the opposite electrodes of the light-emitting element. Thus, a current flows into the light-emitting element, and the light-emitting element emits light.

Note that the potential of the gate terminal of the driving transistor in the selection period is held in the memory circuit. Accordingly, unlike a pixel configuration using a holding capacitor, there are few problems concerning malfunctions of the driving transistor that would be caused when a potential applied to the gate electrode of the driving transistor fluctuates due to the effect of noise, a leakage potential from the switch transistor and the like.

Figure 8B:
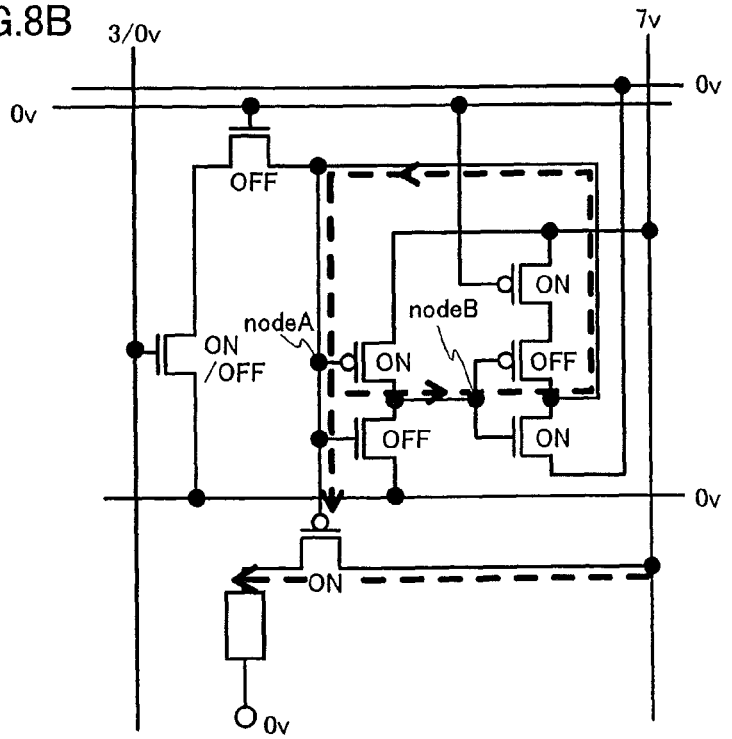

FIG. 8B shows on/off of each transistor and a potential of each wire in the case where the light-emitting element is controlled to hold the emission state in the sustain period in the pixel configuration shown in FIG. 5. Note that dashed arrows schematically show the input path of a potential that is inputted for selecting emission/non-emission of the light-emitting element. A specific potential value of each power source line is set as follows: a potential of the data line is 3/0 V, a potential of the first power source line is 0 V, a potential of the second power source line is 7 V, a potential of the counter electrode of the light-emitting element is 0 V, a potential of the first scan line is an L potential (here, 0 V), and a potential of the second scan line is an L potential (here, 0 V). Note that the specific potential value of each wire shown herein is only an example; therefore, the invention is not limited to this. The potential of each wire is only required to be a potential that enables on/off operation of each transistor.

In FIG. 8B, a potential inputted from the first power source line to be applied to the gate terminal of the driving transistor in the aforementioned selection period is held in the memory circuit, and thus it continues to be applied to the gate terminal of the driving transistor. At this time, the driving transistor is turned on by a potential difference applied between the gate and source of the driving transistor. Then, the second power source line is electrically connected to the light-emitting element, and a voltage is applied to the opposite electrodes of the light-emitting element. Thus, a current flows into the light-emitting element, and the light-emitting element holds the emission state.

In the memory circuit, the L potential of the Node A is inputted to the input terminal of the inverter circuit, and the potential is inverted to be an H potential at the Node B. When the H potential is inputted to the Node B, the holding transistor 506 is turned off and the holding transistor 507 is turned on. Thus, the L potential that is supplied from the second scan line to the second terminal of the holding transistor 507 becomes an output potential of the memory circuit, and thus the driving transistor holds the on state.

In this holding period, the first scan line is at an L potential and the switch transistor is off; therefore, even when the potential of the data line changes to turn on/off the data transistor, neither potential of the memory circuit nor the gate terminal of the driving transistor changes.

Note that the potential of the gate terminal of the driving transistor in the selection period is held in the memory circuit. Accordingly, unlike a pixel configuration using a holding capacitor, there are few problems concerning malfunctions of the driving transistor that would be caused when a potential applied to the gate electrode of the driving transistor fluctuates due to the effect of noise, a leakage potential from the switch transistor and the like.

Figure 9A:
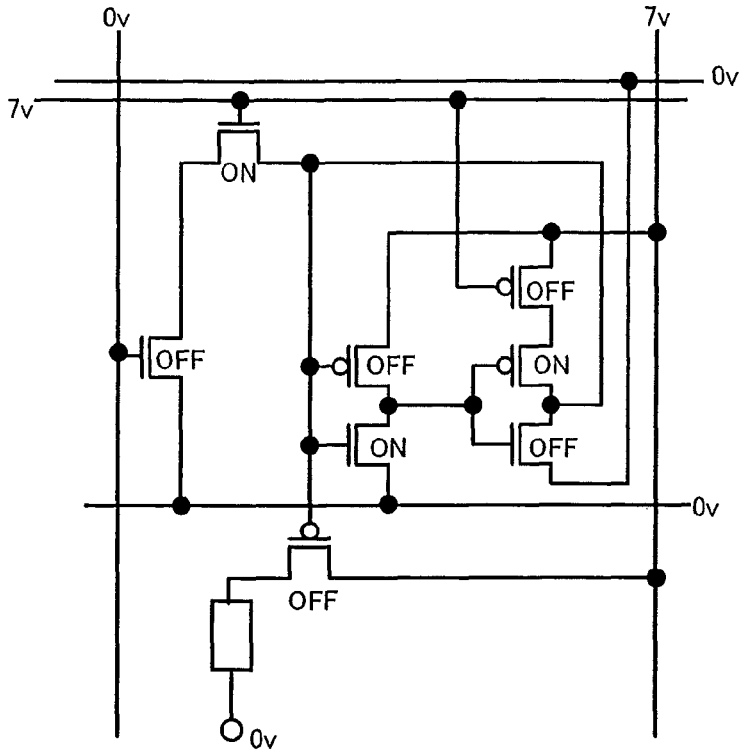
FIG. 9A and FIG. 9B show Embodiment 1 of the invention.

FIG. 9A shows on/off of each transistor and a potential of each wire in the case where the light-emitting element is selected to be in the non-emission state in the selection period in the pixel configuration shown in FIG. 5. A specific potential value of each power source line is set as follows: a potential of the data line is an L potential (here, 0 V), a potential of the first power source line is 0 V, a potential of the second power source line is 7 V, a potential of the counter electrode of the light-emitting element is 0 V, a potential of the first scan line is an H potential (here, 7 V), and a potential of the second scan line is an L potential (here, 0 V). Note that the specific potential value of each wire shown herein is only an example; therefore, the invention is not limited to this. The potential of each wire is only required to be a potential that enables on/off operation of each transistor.

In FIG. 9A, the L potential inputted to the data line is inputted to the gate terminal of the data transistor, thereby the data transistor is turned off. The switch transistor is turned on by the H potential inputted to the first scan line. Therefore, the potential of the first power source line is not inputted to the gate terminal of the driving transistor nor the memory circuit. Also, since the potential of the first scan line is the H potential, the holding transistor 505 is turned off. Thus, since an output from the memory circuit 516 becomes a floating state, the H potential as a reset signal that has been inputted into the memory circuit during the aforementioned reset period is applied to the gate terminal of the driving transistor. At this time, the absolute value of the potential difference applied between the gate and source of the driving transistor becomes lower than the absolute value of the threshold voltage of the driving transistor; therefore, the driving transistor is turned off. Thus, the second power source line is not electrically connected to the light-emitting element, and no current flows into the light-emitting element. Thus, the light-emitting element is turned into the non-emission state.

Note that the potential of the gate terminal of the driving transistor in the selection period is held in the memory circuit. Accordingly, unlike a pixel configuration using a holding capacitor, there are few problems concerning malfunctions of the driving transistor that would be caused when a potential applied to the gate electrode of the driving transistor fluctuates due to the effect of noise, a leakage potential from the switch transistor and the like.

At this time, the holding transistor 503 is turned off in the memory circuit; therefore, an output potential of the memory circuit is not fixed and thus the potential of the gate terminal of the driving transistor becomes a floating state for an instant. Therefore, the selection period is preferably set short. In addition, a capacitor may be connected to the gate terminal of the driving transistor. By providing the capacitor, potential leakage of the driving transistor can be provided.

Figure 9B:
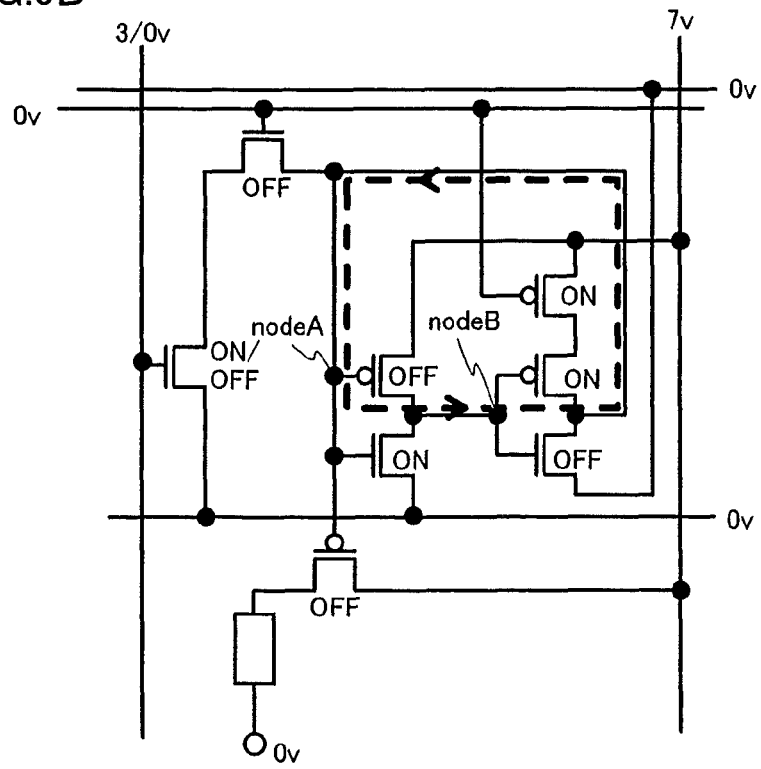

FIG. 9B shows on/off of each transistor and a potential of each wire in the case where the light-emitting element is controlled to hold the non-emission state in the sustain period in the pixel configuration shown in FIG. 5. Note that dashed arrows schematically show the input path of a potential that is inputted for selecting emission/non-emission of the light-emitting element. A specific potential value of each power source line is set as follows: a potential of the data line is 3/0 V, a potential of the first power source line is 0 V, a potential of the second power source line is 7 V, a potential of the counter electrode of the light-emitting element is 0 V, a potential of the first scan line is an L potential (here, 0 V), and a potential of the second scan line is an L potential (here, 0 V). Note that the specific potential value of each wire shown herein is only an example; therefore, the invention is not limited to this. The potential of each wire is only required to be a potential that enables on/off operation of each transistor.

In FIG. 9B, the H potential as a reset signal that has been inputted into the memory circuit in the aforementioned selection period is held in the memory circuit, and thus it continues to be applied to the gate terminal of the driving transistor. At this time, the absolute value of the potential difference applied between the gate and source of the driving transistor becomes lower than the absolute value of the threshold voltage of the driving transistor; therefore, the driving transistor is turned off. Thus, the second power source line is not electrically connected to the light-emitting element, and no current flows into the light-emitting element. Thus, the light-emitting element holds the non-emission state.

In the memory circuit, the H potential of the Node A is inputted to the input terminal of the inverter circuit, and the potential is inverted to be an L potential at the Node B. When the L potential is inputted to the Node B, the holding transistor 506 is turned on and the holding transistor 507 is turned off. At this time, since the first scan line is at an L potential, the holding transistor 503 is turned on. Thus, the H potential that is supplied from the second power source line to the first terminal of the holding transistor 506 becomes an output potential of the memory circuit, and thus the driving transistor holds the off state.

In this holding period, the first scan line is at an L potential and the switch transistor is off; therefore, even when the potential of the data line changes to turn on/off the data transistor, neither potential of the memory circuit nor the gate terminal of the driving transistor is changed.

Note that the potential of the gate terminal of the driving transistor in the holding period is held in the memory circuit. Accordingly, unlike a pixel configuration using a holding capacitor, there are few problems concerning malfunctions of the driving transistor that would be caused when a potential applied to the gate electrode of the driving transistor fluctuates due to the effect of noise, a leakage potential from the switch transistor and the like.

Note that in the aforementioned holding period in which a light-emitting element holds the emission state or non-emission state, even when a signal supply is stopped to a memory circuit in each pixel of the pixel portion from a scan line driver circuit and a data line driver circuit that are disposed on the periphery of the pixel portion, signal data that has been supplied until immediately before the signal supply is stopped can be held; therefore, the light-emitting element can hold the emission state or non-emission state even under the aforementioned circumstance. Therefore, neither the scan line driver circuit nor the data line driver circuit is required to be operated for displaying still images or the like by using the semiconductor device of the invention, and thus a significant reduction in power consumption can be expected.

Figure 24:
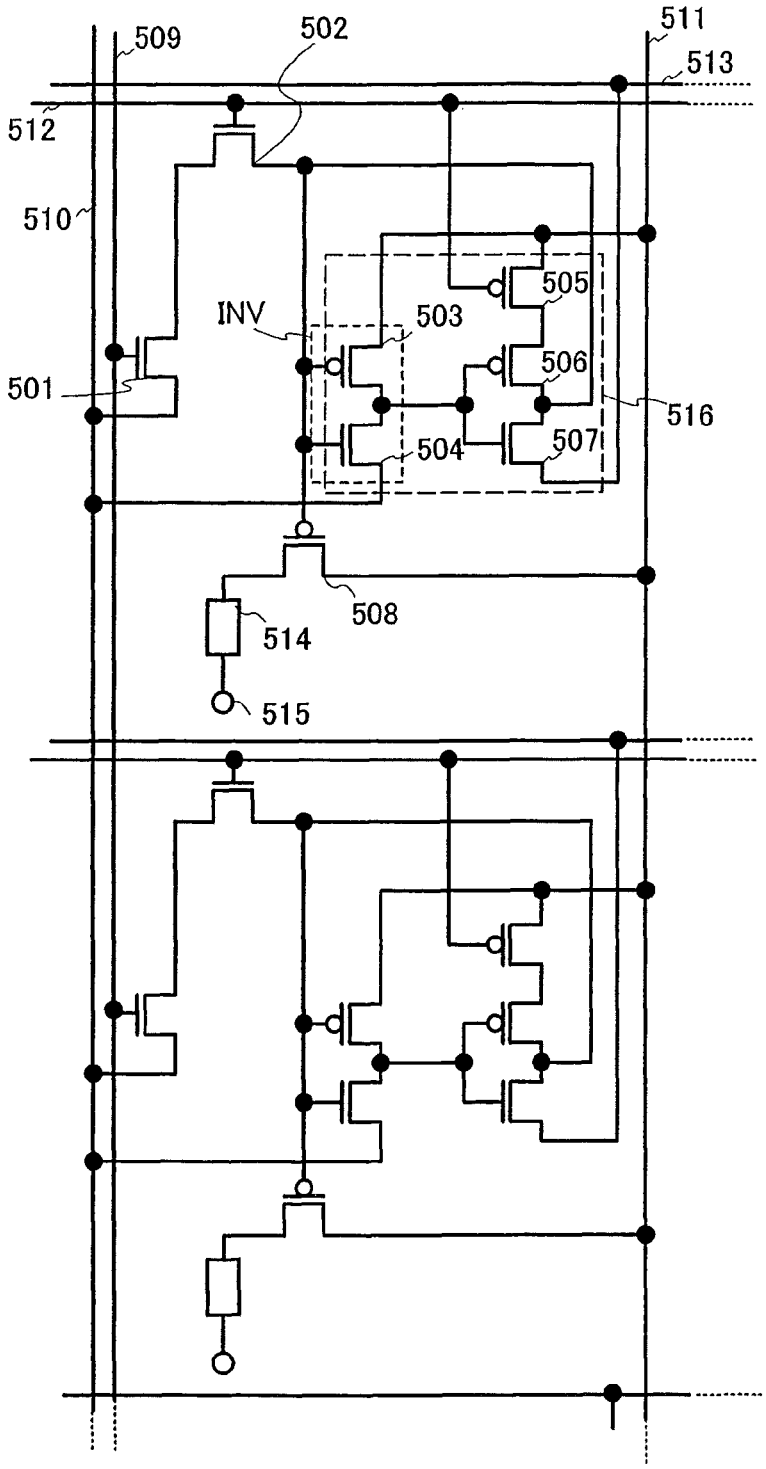
FIG. 24 shows one embodiment mode of the invention.

In addition, in the pixel configuration shown in FIG. 5 of this embodiment, the first power source line 510 may be disposed in parallel with the data line 509 and the second power source line 511 as shown in FIG. 24. By disposing the first power source line 510 in parallel with the data line 509 and the second power source line 511 as shown in FIG. 24, power is not supplied to multiple columns in the case of performing a line sequential drive. Therefore, the configuration of FIG. 24 can suppress a voltage drop due to the wiring resistance or the like in comparison with the case where the first power source line 510 is disposed in parallel with the first scan line 512 and the second scan line 513. Thus, the original design can have a narrow line width.

Note that this embodiment mode can be freely implemented in combination with any of the aforementioned embodiment and other embodiments

Embodiment 2

In this embodiment, description is made on a gray scale expression method where gray scales are expressed by a time gray scale method in the semiconductor device of the invention described in Embodiment 1.

A semiconductor device of the invention is operated by an SES (Simultaneous Erasing Scan) drive. In order to achieve multi-gray scale display by the time gray scale method, an erasing TFT has been required to be used conventionally. In the invention, such an erasing transistor is not required to be provided additionally since a reset period is provided before each selection period.

Figure 10:
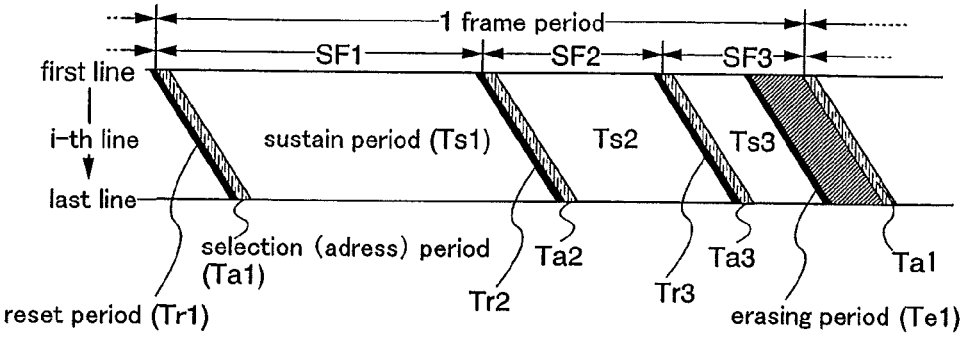
FIG. 10 shows a timing chart in accordance with Embodiment 2 of the invention.

FIG. 10 shows an example where gray scales are expressed by a time gray scale method. FIG. 10 is a timing chart for obtaining 3-bit gray scales, where reset periods Tr1 to Tr3, address (writing) periods Ta1 to Ta3, and sustain (emission) periods Ts1 to Ts3 are provided for the respective bits as well as an erasing period Tel.

In the erasing period of this embodiment, operation in the reset period in Embodiment 1 is performed. That is, such an operation is performed as rewriting the memory circuit that holds a signal for holding the emission state by newly inputting a signal for holding the non-emission state into the memory circuit.

The reset periods and the address (writing) periods each correspond to the period required for inputting video signals to pixels for one image screen; therefore each of the reset periods and the address (writing) periods respectively have an equal length for each bit. To the contrary, each of the sustain (emission) periods has a squared length of the previous period (e.g., 1:2:4: . . . :$2^{(n-1)}$). In the example of FIG. 10, 3-bit gray scales are to be expressed; therefore, each length of the sustain (emission) periods satisfy such ratio as 1:2:4.

The erasing period is originally provided in order to prevent that the address (writing) period in the present sub-frame overlaps the address period in the next sub-frame in the case where the sustain (emission) periods are short, in which case different gate signal lines would be selected concurrently.

This embodiment can be freely implemented in combination with any of the aforementioned embodiment mode and other embodiments.

Embodiment 3

Description is made with reference to the drawings on a top view, a circuit diagram, and a cross-sectional view of a light-emitting device of the invention. More specifically, description is made with reference to FIG. 11A to FIG. 12 on a top view, a circuit diagram, and a cross-sectional view of a light-emitting device including a data transistor, a driving transistor, and a light-emitting element.

Figure 11B:
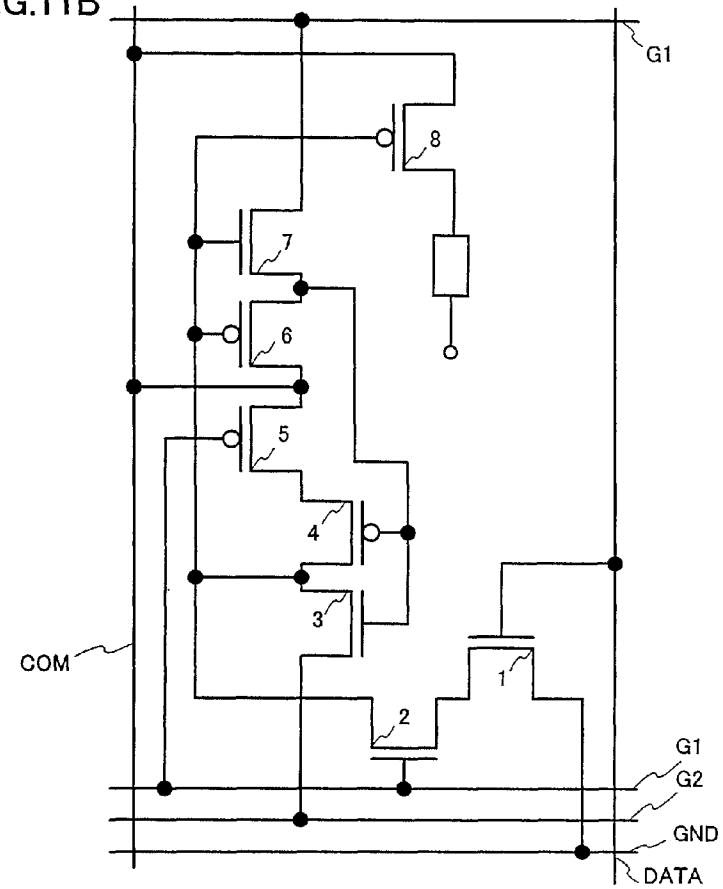
FIG. 11B shows a top view thereof.
Figure 11A:
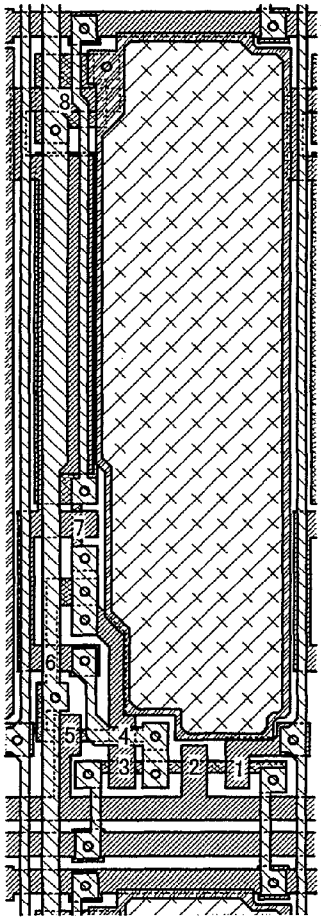
FIG. 11A shows a circuit diagram in accordance with Embodiment 3 of the invention.

FIG. 11A is a top view of a semiconductor device of the invention and FIG. 11B is a circuit diagram of the top view in FIG. 11A. As shown in FIG. 11A and FIG. 11B, a capacitor may be connected to a gate terminal of a driving transistor as required. In FIG. 11B, G1 is a first scan line, G2 is a second scan line, GND is a first power source line, COM is a second power source line, and DATA is a data line. Note that in FIGS. 11A and 11B, each reference numeral of 1 to 8 indicates the corresponding transistor.

Figure 12:
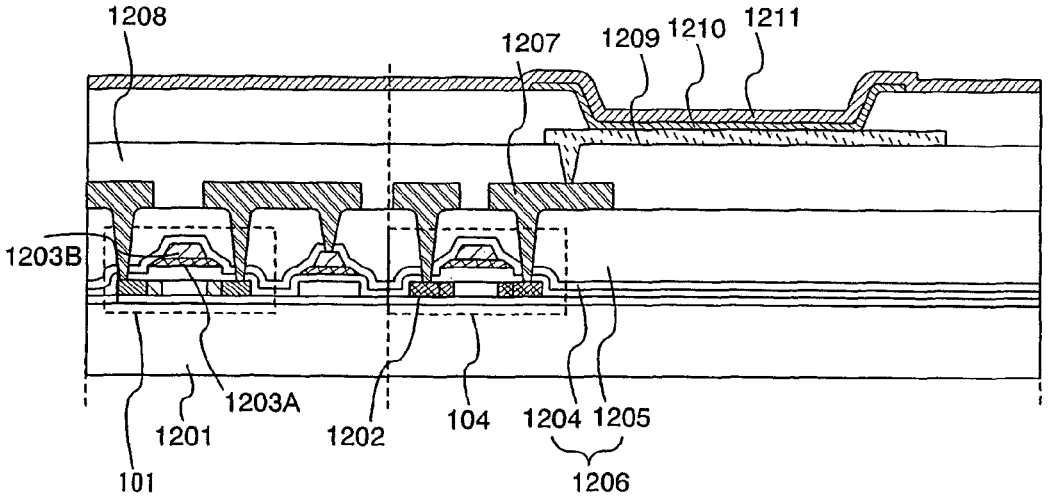
FIG. 12 shows a cross-sectional view in accordance with Embodiment 3 of the invention.

FIG. 12 shows a cross-sectional view corresponding to the top view of FIG. 11A in the area between the GND and the data transistor and between the driving transistor and the light-emitting element. Description is made below on the stacked-layer structure.

As a substrate 1201 having an insulating surface, a glass substrate, a quartz substrate, a stainless steel substrate or the like can be used. Alternatively, a substrate formed of a flexible synthetic resin such as plastic typified by polyethylene terephthalate (PET) or polyethylene naphthalate (PEN), or acrylic may be used.

First, a base film is formed over the substrate 1201. The base film may be an insulating film formed of silicon oxide, silicon nitride, silicon nitride oxide or the like. Then, an amorphous semiconductor film is formed over the base film. The amorphous semiconductor film is formed to have a thickness of 25 to 100 nm. In addition, the amorphous semiconductor film can be formed by using not only silicon but also silicon germanium. Subsequently, the amorphous semiconductor film is crystallized as required, thereby forming a crystalline semiconductor film 1202. The crystallization may be performed by using a heating furnace, laser irradiation, irradiation with light emitted from a lamp, or a combination of them. For example, after adding metal elements into the amorphous semiconductor film, thermal treatment with a heating furnace is applied thereto to form a crystalline semiconductor film. In this manner, it is preferable to add metal elements since crystallization can be performed at a low temperature.

Note that various types of transistors may be used as the transistor in the invention. Therefore, the invention is not limited to a certain type of transistors. A transistor used in the invention may be a thin film transistor (TFT) using a non-single crystalline semiconductor film typified by amorphous silicon or polycrystalline silicon, a MOS transistor formed by using a semiconductor substrate or an SOI substrate, a junction transistor, a bipolar transistor, a transistor using a compound semiconductor such as ZnO or a-InGaZnO, a transistor using an organic semiconductor or a carbon nanotube, or other transistors. In addition, a substrate over which transistors are formed is not limited to a certain type, and various kinds of substrates can be used. Accordingly, transistors can be formed over, for example, a single crystalline substrate, an SOI substrate, a glass substrate, a plastic substrate, a paper substrate, a cellophane substrate, a quartz substrate or the like. Alternatively, after forming transistors over a substrate, the transistors may be transposed onto another substrate.

Note that a thin film transistor (TFT) formed of a crystalline semiconductor has higher electron field-effect mobility than a TFT formed of an amorphous semiconductor, and thus has large on current; therefore, it is more suitable for a semiconductor device.

Then, the crystalline semiconductor film 1202 is patterned into a predetermined shape. Then, an insulating film functioning as a gate insulating film is formed. The insulating film is formed with a thickness of 10 to 150 nm so as to cover the semiconductor film. For example, the insulating film can be formed by using a silicon oxynitride film, a silicon oxide film or the like, and may be formed either to have a single-layer structure or a stacked-layer structure.

Then, a conductive film functioning as a gate electrode is formed over the gate insulating film. Although the gate electrode may be formed either in a single layer or stacked layers, it is formed by stacking conductive films herein. Conductive films 1203A and 1203B are each formed by using an element selected from among Ta, W, Ti, Mo, Al or Cu, or an alloy material or a compound material containing such elements as a main component. In this embodiment, the conductive film 1203A is formed of a tantalum nitride film with a thickness of 10 to 50 nm, and the conductive film 1203B is formed of a tungsten film with a thickness of 200 to 400 nm.

Next, impurity elements are added with the gate electrode as a mask, thereby forming impurity regions. At this time, low concentration impurity regions may be formed in addition to the high concentration impurity regions. The low concentration impurity regions are called LDD (Lightly Doped Drain) regions.

Next, insulating films 1204 and 1205 are formed to function as an interlayer insulating film 1206. The insulating film 1204 is preferably an insulating film containing nitrogen, and here it is formed by using a silicon nitride film with a thickness of 100 nm by plasma CVD. The insulating film 1205 is preferably formed by using an organic material or an inorganic material. As the organic material, there are polyimide, acrylic, polyamide, polyimide amide, benzocyclobutene, and siloxane. Siloxane is composed of a skeleton formed by the bond of silicon (Si) and oxygen (O), a substituent of which includes an organic group containing at least hydrogen (e.g., an alkyl group or aromatic hydrocarbon). Alternatively, a fluoro group may be used as the substituent, or both a fluoro group and an organic group containing at least hydrogen may be used as the substituent. As the inorganic material, there is an insulating film containing oxygen or nitrogen such as silicon oxide ($SiO_x$), silicon nitride ($SiN_x$), silicon oxynitride ($SiO_xN_y$) (x>y) or a silicon nitride oxide ($SiN_xO_y$) (x>y) (where x and y are natural numbers respectively). Note that although a film formed of an organic material has favorable planarity, moisture and oxygen are undesirably absorbed into the organic material. In order to prevent this, an insulating film containing an inorganic material is preferably formed over the insulating film formed of the organic material.

Next, after forming contact holes in the interlayer insulating film 1206, a conductive film 1207 functioning as source and drain wires of transistors is formed. The conductive film 1207 is formed by using an element selected from among aluminum (Al), titanium (Ti), molybdenum (Mo), tungsten (W) or a silicon (Si), or an alloy film containing such elements. In this embodiment, a titanium film, a titanium nitride film, a titanium-aluminum alloy film, and a titanium film are stacked as the conductive film 1207.

Then, an insulating film 1208 is formed to cover the conductive film 1207. The insulating film 1208 can be formed by using a material shown as an example for the interlayer insulating film 1206. Then, a pixel electrode (also referred to as a first electrode) 1209 is formed in an opening provided in the insulating film 1208. The opening is preferably formed to have a roundish edge surface with multiple curvature radii in order to increase the step coverage of the pixel electrode 1209.

The pixel electrode 1209 is preferably formed by using a conductive material with a high work function (4.0 eV or higher) such as a metal, an alloy, an electrically conductive compound, or a mixture of them. As a specific example of the conductive material, there is indium oxide containing tungsten oxide (IWO), indium zinc oxide containing tungsten oxide (IWZO), indium oxide containing titanium oxide (ITiO), indium tin oxide containing titanium oxide (ITTiO), or the like. Needless to say, indium tin oxide (ITO), indium zinc oxide (IZO), indium tin oxide doped with silicon oxide (ITSO), or the like can be used as well.

Exemplary composition ratios of the aforementioned conductive materials are described. The composition ratio of indium oxide containing tungsten oxide is: tungsten oxide is 1.0 wt % and indium oxide is 99.0 wt %. The composition ratio of indium zinc oxide containing tungsten oxide is: tungsten oxide is 1.0 wt %, zinc oxide is 0.5 wt %, and indium oxide is 98.5 wt %. The composition ratio of indium oxide containing titanium oxide is: titanium oxide is 1.0 to 5.0 wt % and indium oxide is 99.0 to 95.0 wt %. The composition ratio of indium tin oxide (ITO) is: tin oxide is 10.0 wt % and indium oxide is 90.0 wt %. The composition ratio of indium zinc oxide (IZO) is: zinc oxide is 10.7 wt % and indium oxide is 89.3 wt %. The composition ratio of indium tin oxide containing titanium oxide is: titanium oxide is 5.0 wt %, tin oxide is 10.0 wt %, and indium oxide is 85.0 wt %. The aforementioned composition ratios are only examples, and therefore, the composition ratios may be set appropriately.

Next, an electroluminescent layer 1210 is formed by vapor deposition or ink-jet deposition. The electroluminescent layer 1210 contains an organic material or an inorganic material, and formed by appropriately combining an electron injection layer (EIL), an electron transporting layer (ETL), a light-emitting layer (EML), a hole transporting layer (HTL), a hole injection layer (HIL), and the like. Note that the boundary between each layer is not necessarily clear, and there may be a case where a material forming each layer is partially mixed with each other, making the interface unclear.

Note that the electroluminescent layer is preferably formed by using multiple layers having different functions such as a hole injection/transporting layer, a light-emitting layer, and an electron injection/transporting layer.

Note also that the hole injection/transporting layer is preferably formed by using a composite material of an organic compound material that has a hole transporting property and an inorganic compound material that has an electron-accepting property with respect to the organic compound material. By providing such a structure, many hole carriers are generated in the organic compound that inherently has few carriers, and thus extremely excellent hole injection/transporting properties can be obtained. With such an effect, a driving voltage can be lowered than the conventional one. Further, since the hole injection/transporting layer can be formed thick without increasing the driving voltage, short circuit of a light-emitting element resulting from dusts or the like can be suppressed.

As the organic compound material having a hole transporting property, there is copper phthalocyanine (abbreviation: CuPc); vanadyl phthalocyanine (abbreviation: VOPc); 4,4',4"-tris(N,N-diphenylamino)triphenylamine (abbreviation: TDATA); 4,4',4"-tris[N-(3-methylphenyl)-N-phenylamino]triphenylamine (abbreviation: MTDATA); 1,3,5-tris[N,N-di(m-tolyl)amino]benzene (abbreviation: m-MTDAB); N,N'-dipheny-N,N-bis(3-methylphenyl)-1,1-biphenyl-4,4-diamine (abbreviation: TPD); 4,4'-bis[N-(1-napthyl)-N-phenylamino]bipheny (abbreviation: NPB); 4,4'-bis[N-[4-{N,N-bis(3-methylphenyl)amino}phenyl]-N-phenylamino]biphenyl (abbreviation: DNTPD); 4,4',4"-tris(N-carbazolyl)triphenylamine (abbreviation: TCTA); or the like. Note that the invention is not limited to these.

Note that as the inorganic compound material having an electron-accepting property, there is titanium oxide, zirconium oxide, vanadium oxide, molybdenum oxide, tungsten oxide, rhenium oxide, ruthenium oxide, zinc oxide or the like. In particular, vanadium oxide, molybdenum oxide, tungsten oxide, or rhenium oxide is preferably used since such material can be easily vapor deposited in vacuum.

Note that the electron injection/transporting layer is formed by using an organic compound material having an electron transporting property. Specifically, there are tris(8-quinolinolato)aluminum (abbreviation: $Alq_3$); tris(4-methyl-8-quinolinolato)aluminum (abbreviation: $Almq_3$); bis(10-hydroxybenzo[h]quinolinato)beryllium (abbreviation: $BeBq_2$); bis(2-methyl-8-quinolinolato)(4-phenylphenolato)aluminum (abbreviation: BAlp); bis[2-(2'-hydroxyphenyl)benzoxazolato]zinc (abbreviation: $Zn(BOX)_2$); bis[2-(2'-hydroxyphenyl)benzothiazolato]zinc (abbreviation: $Zn(BTZ)_2$); bathophenanthroline (abbreviation: BPhen); bathocuproin (abbreviation: BCP); 2-(4-biphenylyl)-5-(4-tert-buthylphenyl)-1,3,4-oxadiazole (abbreviation: PBD); 1,3-bis[5-(4-tert-buthylphenyl)-1,3,4-oxadiazol-2-yl]benzene (abbreviation: OXD-7); 2,2',2"-(1,3,5-benzenetriyl)-tris(1-phenyl-1H-benzimidazole) (abbreviation: TPBI); 3-(4-biphenylyl)-4-phenyl-5-(4-tert-butylphenyl)-1,2,4-triazole (abbreviation: TAZ); 3-(4-biphenylyl)-4-(4-ethylphenyl)-5-(4-tert-butylphenyl)-1,2,4-triazole (abbreviation: p-EtTAZ); and the like. Note that the invention is not limited to these.

The light-emitting layer can be formed by using 9,10-di(2-naphthyl)anthracene (abbreviation: DNA); 9,10-di(2-naphthyl)-2-tert-butylanthracene (abbreviation: t-BuDNA); 4,4'-bis(2,2-diphenylvinyl)biphenyl (abbreviation: DPVBi); coumarin 30; coumarin 6; coumarin 545; coumarin 545T; perylene; rubrene; periflanthene; 2,5,8,11-tetra(tert-butyl)perylene (abbreviation: TBP); 9,10-diphenylanthracene (abbreviation: DPA); 5,12-diphenyltetracene (abbreviation: DPT); 4-(dicyanomethylene)-2-methyl-6-(p-dimethylaminostyryl)-4H-pyran (abbreviation: DCM1); 4-(dicyanomethylene)-2-methyl-6-(9-julolidyl)ethinyl-4H-pyran (abbreviation: DCM2); 4-(dicyanomethylene)-2,6-bis[p-(dimethylamino)styryl]-4H-pyran (abbreviation: BisDCM); or the like. Alternatively, a compound capable of emitting phosphorescence can be used such as bis[2-(4',6'-difluorophenyl)pyridinato-N,$C^{2'}$]iridium(picolinate) (abbreviation: FIr(pic)); bis[2-(3',5'-bis(trifluoromethyl)phenyl)pyridinato-N,$C^{2'}$]iridium(picolinato) (abbreviation: $Ir(CF_3ppy)_2$ (pic)); tris(2-phenylpyridinato-N,$C^{2'}$)iridium (abbreviation: $Ir(ppy)_3$); bis(2-phenylpyridinato-N,$C^{2'}$)iridium(acetylacetonate) (abbreviation: $Ir(ppy)_2(acac)$); bis[2-(T-thienyl)pyridinato-N,$C^{3'}$]iridium(acetylacetonate) (abbreviation: $Ir(thp)_2(acac)$); bis(2-phenylquinolinato-N,$C^{2'}$)iridium(acetylacetonate) (abbreviation: $Ir(pq)_2(acac)$); or bis[2-(2'-benzothienyl)pyridinato-N,$C^{3'}$]iridium(acetylacetonate) (abbreviation: $Ir(btp)_2(acac)$).

Further, the light-emitting layer may be formed by using a singlet excitation light-emitting material as well as a triplet excitation light-emitting material including a metal complex. For example, among light-emitting pixels for red emission, green emission and blue emission, the light-emitting pixel for red emission that has a relatively short luminance half decay period is formed by using a triplet excitation light-emitting material while the other light-emitting pixels are formed by using a singlet excitation light-emitting material. The triplet excitation light-emitting material has high luminous efficiency, which is advantageous in that lower power consumption is required for obtaining the same luminance. That is, when the triplet excitation light-emitting material is applied to the pixel for red emission, the amount of current flown to the light-emitting element can be suppressed, resulting in the improved reliability. In view of power saving, the light-emitting pixels for red emission and green emission may be formed by using a triplet excitation light-emitting material while the light-emitting element for blue emission may be formed by using a singlet excitation light-emitting material. When forming the light-emitting element for green emission that is highly visible to human eyes by using the triplet excitation light-emitting material, further lower power consumption can be achieved.

As a structure of the light-emitting layer, a light-emitting layer having a different emission spectrum may be formed in each pixel to perform color display. Typically, light-emitting layers corresponding to the respective colors of R (red), G (green) and B (blue) are formed. In this case also, color purity can be improved as well as the mirror-like surface (glare) of the pixel portion can be prevented by adopting a structure where a filter for transmitting light with the emission spectrum is provided on the emission side of the pixel. By providing the filter, a circularly polarizing plate and the like that have conventionally been required can be omitted, which can recover the loss of light emitted from the light-emitting layer. Further, changes in color tone, which are recognized when the pixel portion (display screen) is seen obliquely, can be reduced.

Further alternatively, the light-emitting layer can be formed by using an electroluminescent material of high molecular compounds such as polyparaphenylene vinylene, polyparaphenylene, polythiophene or polyfluorene.

In any case, the layer structure of the electroluminescent layer can be changed, and there may be a case where a specific hole or electron injection/transporting layer or light-emitting layer is not provided, but instead, an alternative electrode layer functioning as such layer is provided, or a light-emitting material is dispersed in a layer as long as it can achieve the function of the light-emitting element.

In addition, a color filter (colored layer) may be formed on a sealing substrate. The color filter (colored layer) can be formed by vapor deposition or a droplet discharge method. With the color filter (colored layer), high-resolution display can be performed. This is because the provision of the color filter (colored layer) can correct the broad peak of the emission spectrum of each RGB to be sharp.

In addition, by forming a light-emitting material with a single color and combining a color filter or a color conversion layer with the light-emitting material, full color display can be performed. The color filter (colored layer) or the color conversion layer may be formed on, for example, a second substrate (sealing substrate), and then attached to the base substrate.

Then, a counter electrode (also referred to as a second electrode) 1211 is formed by sputtering or vapor deposition.

One of the pixel electrode 1209 and the counter electrode 1211 functions as an anode while the other functions as a cathode.

As a cathode material, a material having a low work function (3.8 eV or lower) is preferably used such as metals, alloys, electrically conductive compounds, or a mixture of them. As a specific example of the cathode material, there are metals belonging to the group 1 or 2 of the periodic table, namely alkaline metals such as Li or Cs, alkaline earth metals such as Mg, Ca or Sr, alloys containing such metals (Mg:Ag or Al:Li), compounds containing such metals (LiF, CsF or calcium fluoride), or transition metals containing rare-earth metals. Note that since the cathode is required to transmit light, the aforementioned metals or alloys thereof are formed to be quite thin, and a metal (including an alloy) such as ITO is stacked thereon.

Then, a protective film formed of a silicon nitride film or a DLC (Diamond Like Carbon) film may be provided so as to cover the counter electrode 1211. Through the aforementioned steps, a light-emitting device of the invention is completed.

This embodiment can be freely implemented in combination with any of the aforementioned embodiment mode and other embodiments.

Embodiment 4

Figure 13A:
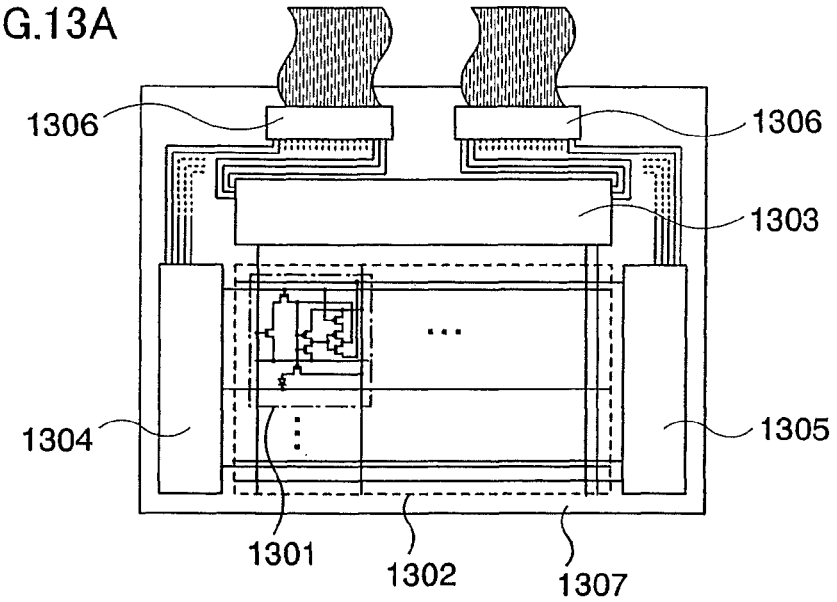
FIG. 13A is a top view showing a configuration in accordance with Embodiment 4 of the invention.
Figure 13B:
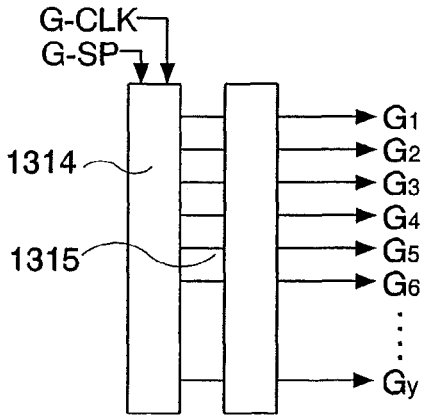
FIG. 13B and FIG. 13C are block diagrams thereof.
Figure 13C:
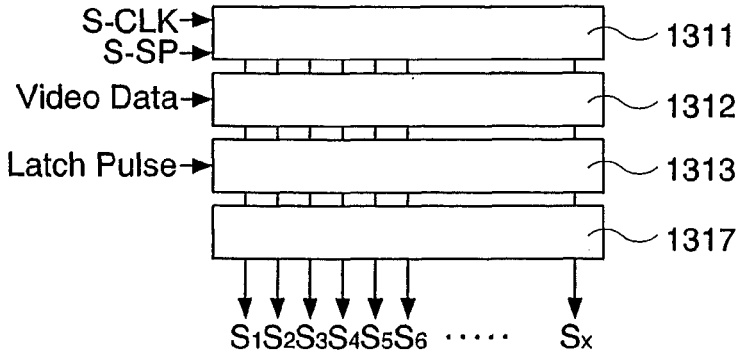

In this embodiment, description is made with reference to FIG. 13A to FIG. 13C on a configuration of a display device.

In FIG. 13A, a pixel portion 1302 where multiple pixels 1301 are arranged in matrix is formed over a substrate 1307. On the periphery of the pixel portion 1302, a signal line drive circuit 1303, a first scan line driver circuit 1304, and a second scan line driver circuit 1305 are formed. Such driver circuits are supplied with signals from outside through an FPC 1306.

FIG. 13B shows a configuration of each of the first scan line driver circuit 1304 and the second scan line driver circuit 1305. Each of the scan line driver circuits 1304 and 1305 has a shift register 1314 and a buffer 1315. FIG. 13C shows a configuration of the signal line driver circuit 1303. The signal line driver circuit 1303 has a shift register 1311, a first latch circuit 1312, a second latch circuit 1313, and a buffer 1317.

Note that the configurations of the scan line driver circuits and the signal line driver circuit are not limited to the aforementioned ones, and for example, a sampling circuit, a level shifter and the like may be provided. In addition, a CPU, a controller and other circuits may be formed over the substrate 1307 together with the pixel portion 1302 in addition to the aforementioned driver circuits. Accordingly, the number of external circuits (ICs) connected can be reduced, and further reduction in weight and thickness can be achieved. Thus, the display device can be more effectively applied to a portable terminal or the like.

Note that in this specification, a display device such as a panel shown in FIG. 13A where an FPC is connected and an EL element is used for a light-emitting element is called an EL module.

This embodiment can be freely implemented in combination with any of the aforementioned embodiment mode and other embodiments.

Embodiment 5

In this embodiment, description is made on a method for correcting a potential of a second power source line in order to reduce the effect of fluctuations of a current value of a light-emitting element that results from changes in the ambient temperature and degradation with time.

A light-emitting element has a characteristic that a resistance value (internal resistance value) thereof changes in accordance with changes in the ambient temperature. Specifically, on the assumption that the room temperature is a normal temperature, the resistance value of a light-emitting element decreases when the ambient temperature becomes higher than the normal temperature, while increasing when the ambient temperature becomes lower than the normal temperature. Therefore, when the ambient temperature becomes higher, a current flowing in the light-emitting element increases and thus the luminance thereof becomes higher than the predetermined level. On the other hand, when the ambient temperature becomes lower, a current flowing in the light-emitting element decreases even with the same voltage being applied, and thus the luminance thereof becomes lower than the predetermined level. In addition, the light-emitting element has another characteristic that the current value flowing therein decreases along with degradation with time. Specifically, when the total emission period and non-emission period have accumulated, the resistance value of the light-emitting element increases along with degradation. Therefore, when the total emission period and non-emission period have accumulated, a current value flowing in the light-emitting element decreases even with the same voltage being applied, and thus the luminance thereof becomes lower than the predetermined level.

Due to the aforementioned inherent characteristics of the light-emitting element, luminance varies when the ambient temperature changes or degradation is caused with time. In this embodiment, the effect of fluctuations of a current value of a light-emitting element that results from changes in the ambient temperature and degradation with time can be suppressed by performing corrections using a potential of a second power source line of the invention.

Figure 14:
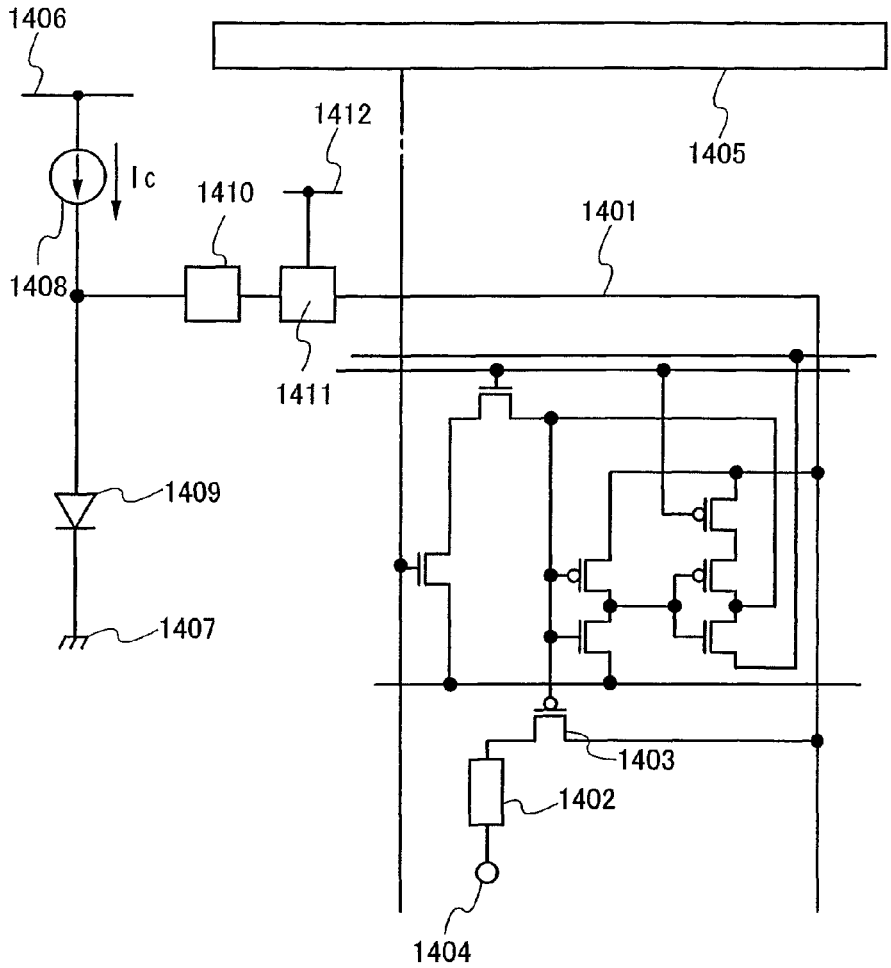
FIG. 14 shows a circuit diagram in accordance with Embodiment 5 of the invention.

FIG. 14 shows a circuit configuration. The pixel shown in FIG. 14 has the same components as those in FIG. 5. Therefore, description on the same configuration as that of FIG. 5 is omitted here. In FIG. 14, a driving transistor 1403 and a light-emitting element 1402 are connected between a second power source line 1401 and a counter electrode 1404 shown in FIG. 5. A current flows from the second power source line 1401 to the counter electrode 1404. The light-emitting element 1402 emits light at a luminance corresponding to the amount of current flowing therein.

If a potential of the second power source line 1401 and the counter electrode 1404 are fixed in such a pixel configuration, the characteristics of the light-emitting element 1402 degrade when a current continuously flows into the light-emitting element 1402. In addition, the characteristics of the light-emitting element 1402 also change when the ambient temperature changes.

Specifically, if a current continuously flows into the light-emitting element 1402, the voltage-current characteristics thereof shift. That is, the resistance value of the light-emitting element 1402 increases, and the current value flowing therein decreases even with the same voltage being applied. In addition, even when the same amount of current flows into the light-emitting element 1402, the luminous efficiency decreases and the luminance becomes lower. As a temperature characteristic, the voltage-current characteristics of the light-emitting element 1402 shift when the ambient temperature becomes lower, and thus the resistance value of the light-emitting element 1402 increases.

Therefore, the effect of the aforementioned degradation with time and characteristic change in accordance with changes in the ambient temperature is corrected by using a monitoring circuit. In this embodiment, the potential of the second power source line 1401 is adjusted to correct the degradation of the light-emitting element 1402 with time and the characteristic change thereof in accordance with changes in the ambient temperature.

Thus, description is made on a configuration of a monitoring circuit. A monitoring current source 1408 and a monitoring light-emitting element 1409 are connected between a first monitoring power source 1406 and a second monitoring power source 1407. A connecting node of the monitoring light-emitting element 1409 and the monitoring current source 1408 are connected to an input terminal of a sampling circuit 1410 for outputting a voltage of the monitoring light-emitting element 1409. An output terminal of the sampling circuit 1410 is connected to a second power source line 1401. Accordingly, a potential of the second power source line 1401 is controlled by the output of the sampling circuit 1410.

Next, operation of the monitoring circuit is described. First, in the case where the light-emitting element 1402 is controlled to emit light corresponding to the highest gray scale, the monitoring current source 1408 supplies a current with a predetermined value to the light-emitting element 1402. The current value at this time is indicated by Imax.

Then, a voltage necessary for flowing the current of Imax is applied to both electrodes of the monitoring light-emitting element 1409. Even if the voltage-current characteristics of the monitoring light-emitting element 1409 change in accordance with the degradation with time or changes in the ambient temperature, a voltage applied to the both electrodes of the monitoring light-emitting element 1409 changes accordingly to have an optimal value. Therefore, the effect of changes (degradation with time, changes in the ambient temperature, and the like) of the monitoring light-emitting element 1409 can be corrected.

A voltage applied to the monitoring light-emitting element 1409 is inputted to the input terminal of the sampling circuit 1410. The output potential of the sampling circuit 1410 is connected to a power source circuit 1411 connected to a power source line 1412 for the power source circuit.

The power source circuit 1411 supplies a potential in accordance with the potential from the output terminal of the sampling circuit 1410 to the second power source line 1401. That is, the potential of the second power source line 1401 is corrected by the monitoring circuit 1410, thereby the light-emitting element 1402 is corrected of its degradation with time and characteristic change in accordance with changes in the ambient temperature.

Note that the sampling circuit 1410 may be any circuit capable of sampling and holding a voltage in accordance with a current inputted to the monitoring light-emitting element 1409. For example, a voltage inputted may be sampled by using a switching element such as a MOS transistor and a capacitor.

The power source circuit 1411 may be any circuit capable of outputting a voltage inputted. For example, it may be constructed by using an operational amplifier, a bipolar transistor or a MOS transistor, or a combination of these.

Note that the monitoring light-emitting element 1409 is desirably formed over the same substrate as, by the same manufacturing method as, and concurrently with the light-emitting element 1402 in the pixel. This is because if there is a difference in characteristics between the monitoring light-emitting element and the light-emitting element in the pixel, accurate correction cannot be carried out.

Note that there are periods when current is not supplied to the light-emitting element 1402 in the pixel frequently; therefore, the monitoring light-emitting element 1409 degrades at faster speed if a current is continuously supplied to the monitoring light-emitting element 1409. Therefore, a potential outputted from the sampling circuit 1410 corresponds to a potential to which high degree of correction is applied. Thus, the correction may be carried out in accordance with the actual degradation level of the light-emitting element in the pixel. For example, if the average emission rate of the whole pixels is 30%, a current may be supplied to the monitoring light-emitting element 1409 only in the period corresponding to 30% of the luminance. At this time, there arises a period when no current is supplied to the monitoring light-emitting element 1409; however, voltage is required to be continuously supplied from the output terminal of the sampling circuit 1410. In order to realize this, a capacitor may be connected to the input terminal of the sampling circuit 1410 so as to hold a potential of the time when a current has been supplied to the monitoring light-emitting element 1409.

Note that when the monitoring circuit is operated in accordance with the highest gray scale, a potential that is subjected to high degree of correction is outputted, which can make a screen burn in the pixels (luminance unevenness due to variations of degradation levels among pixels) less noticeable. Therefore, the monitoring circuit is desirably operated in accordance with the highest gray scale.

In this embodiment, it is further preferable to operate the driving transistor 1403 in the linear region. By operating the driving transistor 1403 in the linear region, it can roughly operate as a switch. Therefore, the effect of the characteristic change of the driving transistor 1403 due to degradation with time or changes in the ambient temperature can be lessened. In the case of operating the driving transistor 1403 only in the linear region, current supply to the light-emitting element 1404 is often controlled digitally. In such a case, it is preferable to combine a time gray scale method, an area gray scale method and the like in order to achieve multi-gray scale display.

This embodiment can be freely implemented in combination with any of the aforementioned embodiment mode and other embodiments.

Embodiment 6

As an electronic apparatus having the semiconductor device of the invention, there are a television receiver, a camera (e.g., video camera or a digital camera), a goggle display, a navigation system, an audio reproducing device (e.g., a car audio component set), a computer, a game machine, a portable information terminal (e.g., a mobile computer, a portable phone, a portable game machine, or an electronic book), an image reproducing device provided with a recording medium (specifically, a device for reproducing a recording medium such as a digital versatile disc (DVD) and having a display portion for displaying the reproduced image), and the like. Specific examples of such electronic apparatuses are shown in FIG. 15, FIG. 16, FIG. 17A, FIG. 17B, FIG. 18A, FIG. 18B, FIG. 19, and FIG. 20A to FIG. 20E.

Figure 15:
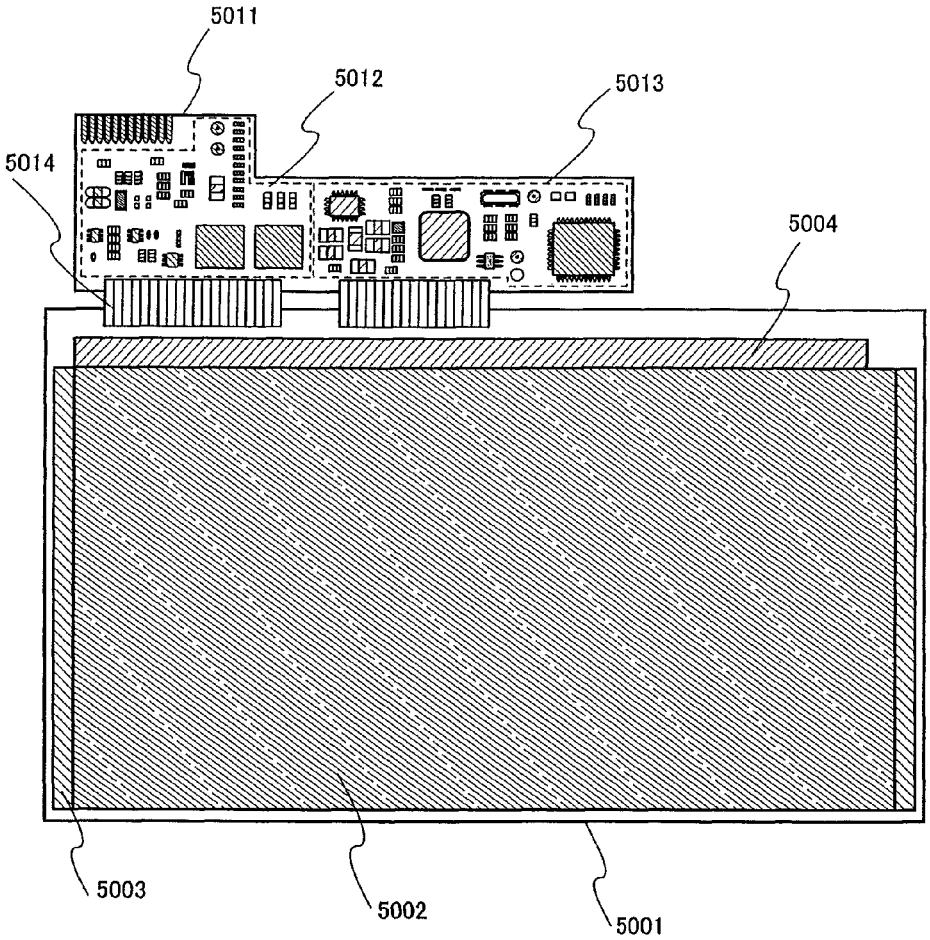
FIG. 15 shows an electronic apparatus in accordance with Embodiment 6 of the invention.

FIG. 15 shows an EL module constructed by combining a display panel 5001 and a circuit board 5011. Over the circuit board 5011, a control circuit 5012, a signal dividing circuit 5013 and the like are formed, which are electrically connected to the display panel 5001 through a connecting wire 5014.

The display panel 5001 has a pixel portion 5002 where multiple pixels are provided, a scan line driver circuit 5003, and a signal line driver circuit 5004 for supplying a video signal to a selected pixel. Note that in the case of manufacturing an EL module, the semiconductor device that constitutes the pixels in the pixel portion 5002 may be manufactured by using the aforementioned embodiments. In addition, a control driver circuit portion such as the scan line driver circuit 5003 and the signal line driver circuit 5004 can be manufactured by using TFTs formed in accordance with the aforementioned embodiments. In this manner, an EL module television shown in FIG. 15 can be completed.

Figure 16:
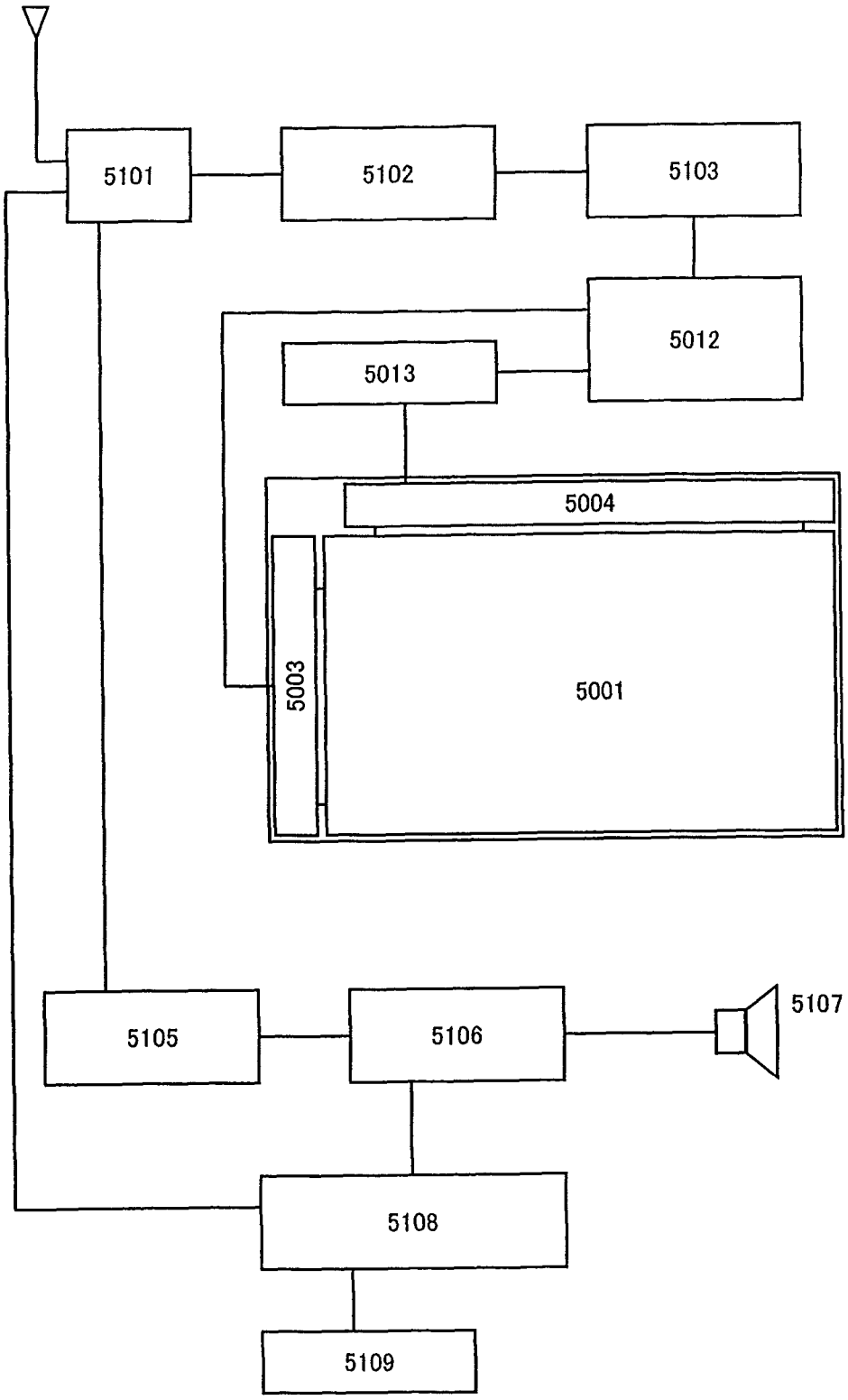
FIG. 16 shows an electronic apparatus in accordance with Embodiment 6 of the invention.

FIG. 16 is a block diagram showing the main configuration of an EL television receiver. A tuner 5101 receives video signals and audio signals. The video signals are processed by a video signal amplifying circuit 5102, a video signal processing circuit 5103 for converting the output signals from 5102 to color signals corresponding to the respective colors of red, green and blue, and the control circuit 5012 for converting the video signals to be inputted into a driver IC. The control circuit 5012 outputs signals to each of a scan line side and a signal line side. When performing digital drive, the signal dividing circuit 5013 may be provided on the signal line side so that the inputted digital signal is divided into m signals to be supplied to the display panel 5001.

Among the signals received at the tuner 5101, audio signals is transmitted to the audio signal amplifying circuit 5105, and an output thereof is supplied to a speaker 5107 through an audio signal processing circuit 5106. A control circuit 5108 receives control data on the receiving station (receive frequency) and volume from an input portion 5109, and transmits the signal to the tuner 5101 and the audio signal processing circuit 5106.

Figure 17A:
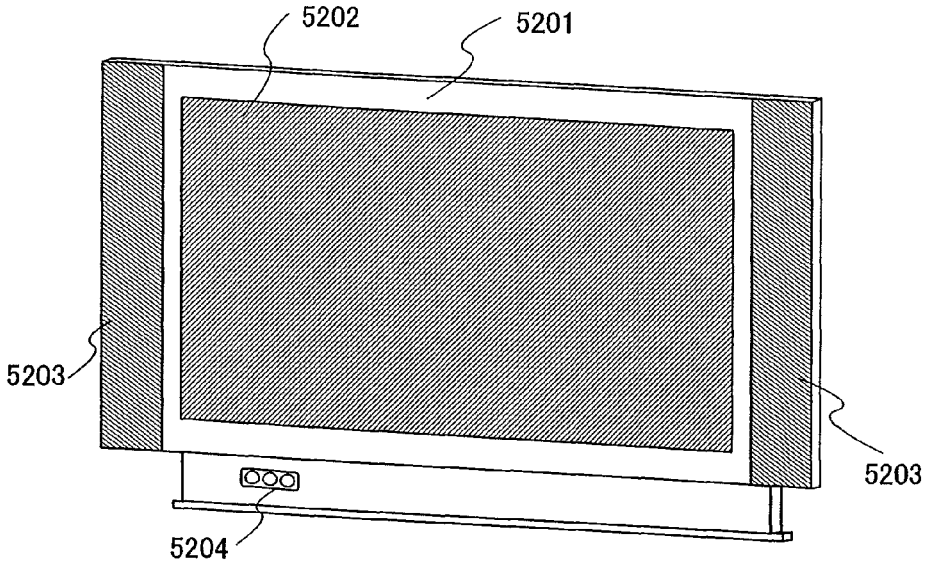
FIG. 17A and FIG. 17B each show an electronic apparatus in accordance with Embodiment 6 of the invention.

As shown in FIG. 17A, a television receiver can be completed by incorporating an EL module into a housing 5201. A display screen 5202 is formed by the EL module. In addition, speakers 5203, an operating switch 5204 and the like are appropriately provided.

Figure 17B:
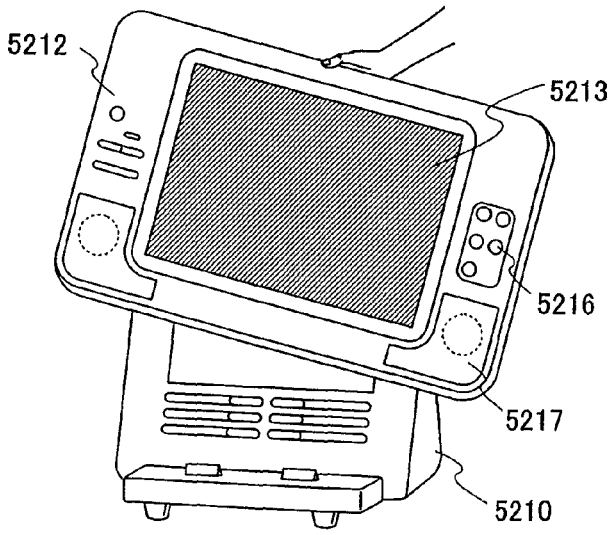

FIG. 17B shows a television receiver, only a display of which is wireless and portable. A housing 5212 is incorporated with a battery and a signal receiver, and the battery drives a display portion 5213 and a speaker portion 5217. The battery can be repeatedly charged with a battery charger 5210. In addition, the battery charger 5210 can transmit/receive video signals, and transmit the video signals to the signal receiver of the display. The housing 5212 is controlled with an operating key 5216. The device shown in FIG. 17B can also transmit signals from the housing 5212 to the battery charger 5210 by operating the operating key 5216; therefore, it can also be called a video/audio two-way communication device. In addition, the device can also perform communication control of other electronic apparatuses by operating the operating key 5216 to transmit signals from the housing 5212 to the battery charger 5210 and further by controlling the other electronic apparatuses to receive signals that the battery charger 5210 can transmit; therefore, the device can also be called a general-purpose remote control device. The invention can be applied to the display portion 5213.

By applying the semiconductor device of the invention to the television receivers shown in FIG. 15, FIG. 16, FIG. 17A and FIG. 17B, a constant potential is continuously supplied to a gate terminal of a driving transistor regardless of whether a light-emitting element in a pixel of a display portion is in the emission state or non-emission state. Therefore, products with more stable operation can be manufactured as compared to the conventional pixel configuration where a potential is held in a holding capacitor, and thus less defective goods can be provided to customers.

Further, by applying the semiconductor device of the invention to the television receivers shown in FIG. 15, FIG. 16, FIG. 17A and FIG. 17B, on/off potentials applied to a gate electrode of a driving transistor can be set separately from a potential of a data line. Accordingly, the potential amplitude of the data line can be set small, and a semiconductor device with a significantly suppressed power consumption can be provided. Thus, goods with significantly suppressed power consumption can be provided to customers.

Needless to say, the invention is not limited to a television receiver, and can be applied to various objects such as a monitor of a personal computer, an information display board at the train station or airport, or a large-area advertising display medium such as an advertising display board on the street.

Figure 18A:
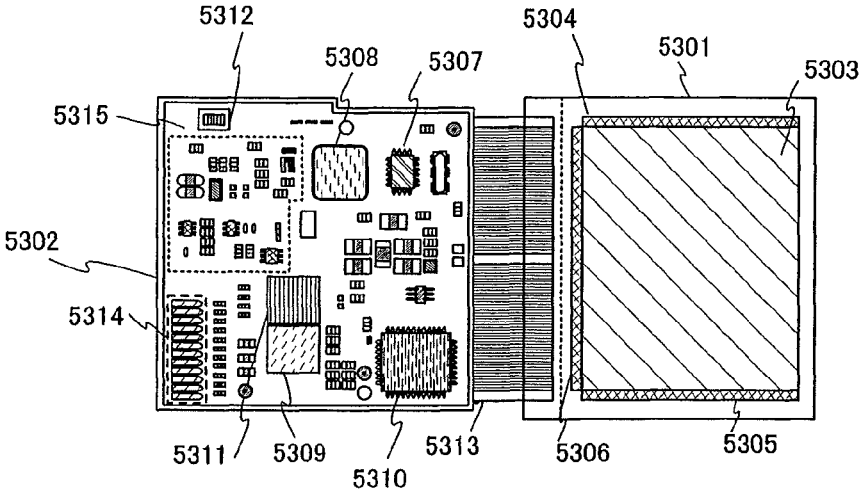
FIG. 18A and FIG. 18B each show an electronic apparatus in accordance with Embodiment 6 of the invention.

FIG. 18A shows a module constructed by combining a display panel 5301 and a printed wiring board 5302. The display panel 5301 has a pixel portion 5303 where multiple pixels 5303 are provided, a first scan line driver circuit 5304, a second scan line driver circuit 5305, and a signal line driver circuit 5306 for supplying a video signal to a selected pixel.

The printed wiring board 5302 is provided with a controller 5307, a central processing unit (CPU) 5308, a memory 5309, a power supply circuit 5310, an audio processing circuit 5311, a transmission/reception circuit 5312 and the like. The printed wiring board 5302 and the display panel 5301 are connected through a flexible printed wiring board (FPC) 5313. The printed wiring board 5313 may be provided with a capacitor, a buffer circuit and the like in order to prevent noise interruption on the power supply voltage or signals and also prevent dull signal rising. In addition, the controller 5307, the audio processing circuit 5311, the memory 5309, the CPU 5308, the power supply circuit 5310 and the like can be mounted on the display panel 5301 by COG (Chip On Glass) bonding. By the COG bonding, a scale of the printed wiring board 5302 can be reduced.

Various control signals are inputted/outputted through an interface (I/F) portion 5314 provided on the printed wiring board 5302. In addition, an antenna port 5315 for transmitting/receiving signals to/from an antenna is provided on the printed wiring board 5302.

Figure 18B:
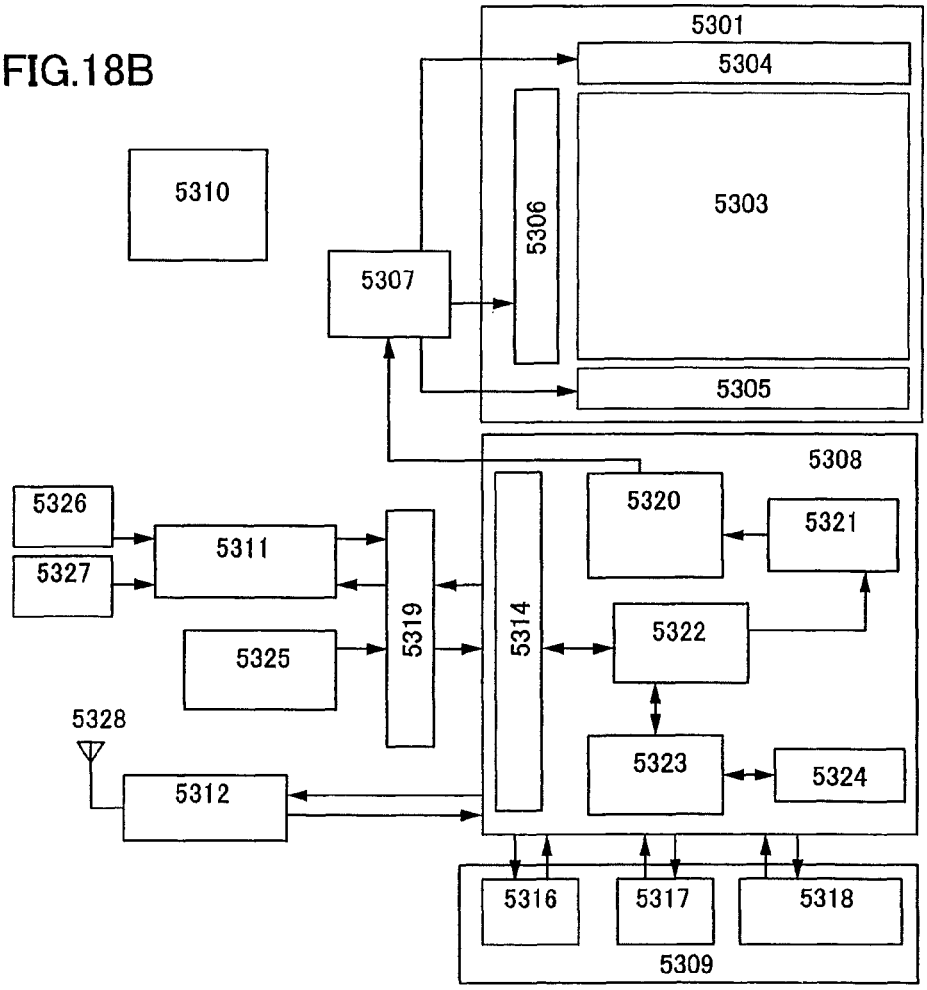

FIG. 18B is a block diagram of the module shown in FIG. 18A. This module includes a VRAM 5316, a DRAM 5317, a flash memory 5318 and the like as the memory 5309. The VRAM 5316 stores image data to be displayed on the panel, the DRAM 5317 stores image data or audio data, and the flash memory 5318 stores various programs.

The power supply circuit 5310 supplies power to operate the display panel 5301, the controller 5307, the CPU 5308, the audio processing circuit 5311, the memory 5309 and the transmission/reception circuit 5312. Depending on the specification of the panel, the power supply circuit 5310 may be provided with a current source.

The CPU 5308 includes a control signal generation circuit 5320, a decoder 5321, a register 5322, an arithmetic circuit 5323, a RAM 5324, an interface 5319 for the CPU 5308 and the like. Various signals inputted to the CPU 5308 through the interface 5319 are once stored in the register 5322 before inputted to the arithmetic circuit 5323, the decoder 5321 and the like. The arithmetic circuit 5323 performs operation based on the signals inputted, and specifies an address for sending various instructions. On the other hand, signals inputted to the decoder 5321 are decoded, and inputted to the control signal generation circuit 5320. The control signal generation circuit 5320 generates signals containing various instructions based on the signals inputted, and transmits them to an address specified in the arithmetic circuit 5323, specifically such as the memory 5309, the transmission/reception circuit 5312, the audio processing circuit 5311, the controller 5307 and the like.

The memory 5309, the transmission/reception circuit 5312, the audio processing circuit 5311, and the controller 5307 operate in accordance with the respective instructions received. The operation is described briefly below.

Signals inputted from an input means 5325 are transmitted to the CPU 5308 mounted on the printed wiring board 5302 through the I/F portion 5314. The control signal generation circuit 5320 converts image data stored in the VRAM 5316 into a predetermined format in accordance with signals transmitted from the input means 5325 such as a pointing device and a keyboard, and then transmits the data to the controller 5307.

The controller 5307 processes signals containing image data that are transmitted from the CPU 5308 in accordance with the specification of the panel, and then supplies the data to the display panel 5301. In addition, the controller 5307 generates Hsync signals, Vsync signals, clock signals CLK, AC voltage (AC Cont), and switching signals L/R based on the power supply voltage inputted from the power supply circuit 5310 and the various signals inputted from the CPU 5308, and supplies them to the display panel 5301.

The transmission/reception circuit 5312 processes signals that have been transmitted/received as electromagnetic waves at an antenna 5328, and specifically includes high frequency circuits such as an isolator, a bandpass filter, a VCO (Voltage Controlled Oscillator), an LPF (Low Pass Filter), a coupler and a balun. Among signals transmitted/received to/from the transmission/reception circuit 5312, signals containing audio data are transmitted to the audio processing circuit 5311 in accordance with the instruction from the CPU 5308.

The signals containing audio data that are transmitted in accordance with the instruction from the CPU 5308 are demodulated into audio signals in the audio processing circuit 5311 and then transmitted to a speaker 5327. Audio signals transmitted from a microphone 5326 are modulated in the audio processing circuit 5311, and then transmitted to the transmission/reception circuit 5312 in accordance with the instruction from the CPU 5308.

The controller 5307, the CPU 5308, the power supply circuit 5310, the audio processing circuit 5311, and, the memory 5309 can be integrated as a package of this embodiment. This embodiment can be applied to any circuits except high frequency circuits such as an isolator, a bandpass filter, a VCO (Voltage Controlled Oscillator), a LPF (Low Pass Filter), a coupler and a balun.

Figure 19:
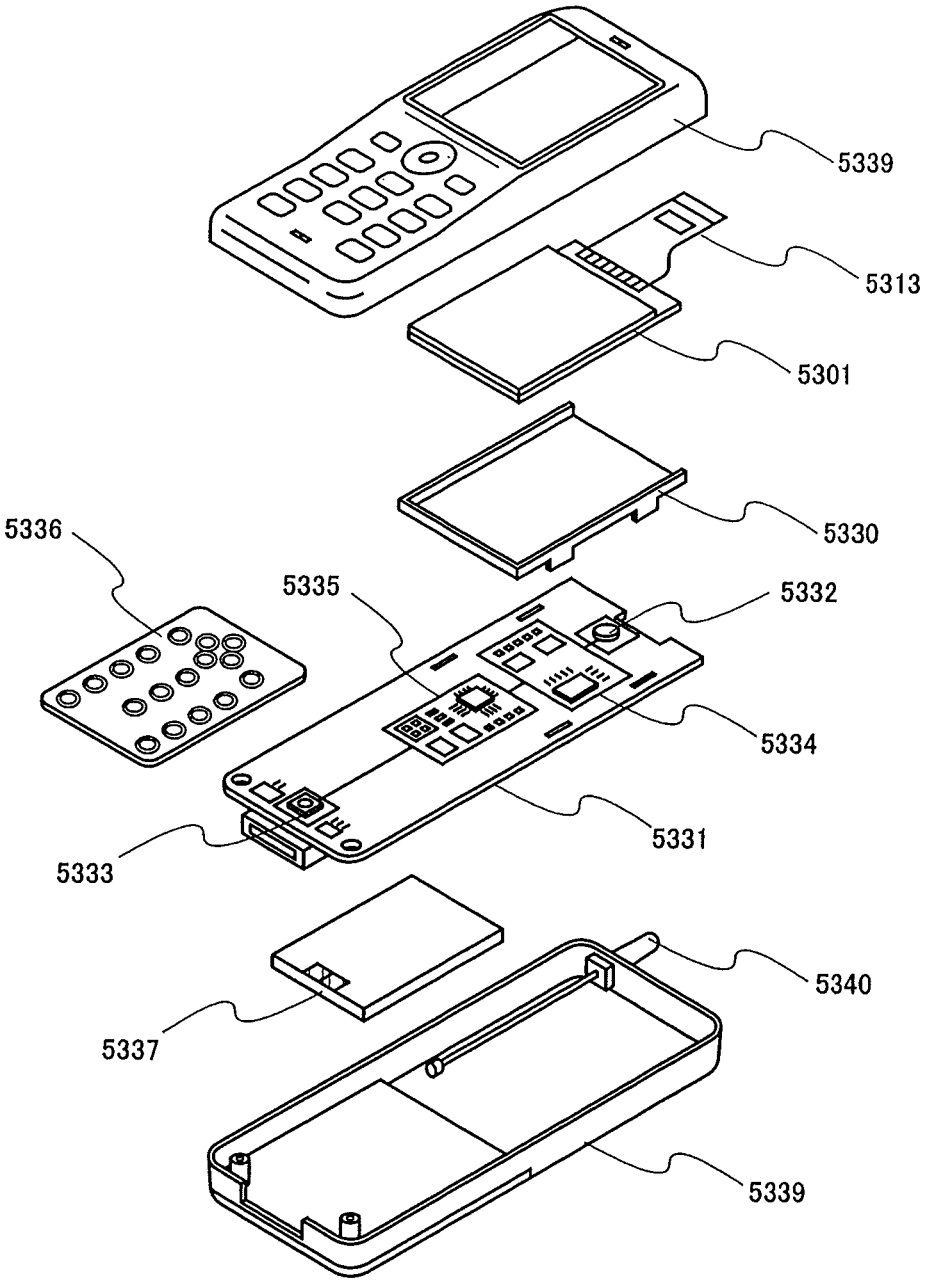
FIG. 19 shows an electronic apparatus in accordance with Embodiment 6 of the invention.

FIG. 19 shows one mode of a portable phone including the module shown in FIG. 18A and FIG. 18B. The display panel 5301 can be incorporated into a housing 5330 in an attachable/detachable manner. The shape and size of the housing 5330 can be appropriately changed in accordance with the size of the display panel 5301. The housing 5330 to which the display panel 5301 is fixed is fit into a printed board 5331 so as to be assembled as a module.

The display panel 5301 is connected to the printed board 5331 through an FPC 5313. On the printed board 5331, a speaker 5332, a microphone 5333, a transmission/reception circuit 5334, and a signal processing circuit 5335 including a CPU, a controller and the like are formed. Such module is combined with an input means 5336, a battery 5337 and an antenna 5340, and then incorporated into housings 5339. A pixel portion of the display panel 5301 is disposed so that it can be seen from an open window formed in the housing 5339.

The portable phone in accordance with this embodiment can be changed into various modes in accordance with the function or applications. For example, multiple display panels may be provided and the housing may be appropriately divided into multiple units so as to enable the portable phone to be folded/unfolded with a hinge.

In the portable phone in FIG. 19, the display panel 5301 is constructed of a matrix arrangement of the pixels in the semiconductor device described in embodiment mode. In the semiconductor device, on/off potentials applied to a gate electrode of a driving transistor can be set separately from a potential of a data line, and a constant potential can be continuously supplied to the gate terminal of the driving transistor regardless of whether a light-emitting element in the pixel is in the emission state or non-emission state. Accordingly, the potential amplitude of the data line can be set small to reduce power consumption, and more stable operation can be performed as compared to the conventional pixel configuration where a potential is held in a holding capacitor. Since the display panel 5301 constructed of such a semiconductor device has a similar function, the portable phone can achieve low power consumption and stable display operation. With such characteristics, the power source circuits can be significantly reduced in number or scale to reduce defective display; therefore, reduction in size and weight of the housing 5339 can be achieved. Since the portable phone in accordance with the invention can achieve reduction in power consumption and weight, products with improved portability can be provided to customers.

Figure 20A:
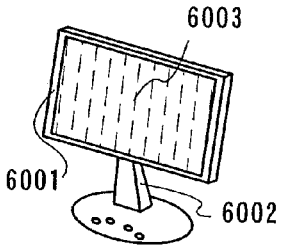
FIG. 20A to FIG. 20E show electronic apparatuses in accordance with Embodiment 6 of the invention.

FIG. 20A is a television set including a housing 6001, a support base 6002, a display portion 6003 and the like. In this television set, the display portion 6003 is constructed of a matrix arrangement of the pixels in the semiconductor device described in embodiment mode. In the semiconductor device, on/off potentials applied to a gate electrode of a driving transistor can be set separately from a potential of a data line, and a constant potential can be continuously supplied to the gate terminal of the driving transistor regardless of whether a light-emitting element in the pixel is in the emission state or non-emission state. Accordingly, the potential amplitude of the data line can be set small to reduce power consumption, and more stable operation can be performed as compared to the conventional pixel configuration where a potential is held in a holding capacitor. Since the display portion 6003 constructed of such a semiconductor device has a similar function, the television set can achieve low power consumption and stable display operation. With such characteristics, the power source circuits can be significantly reduced in number or scale to reduce defective display; therefore, reduction in size and weight of the housing 6001 can be achieved. Since the television set in accordance with the invention can achieve reduction in power consumption and weight, products with improved portability can be provided to customers.

Figure 20B:
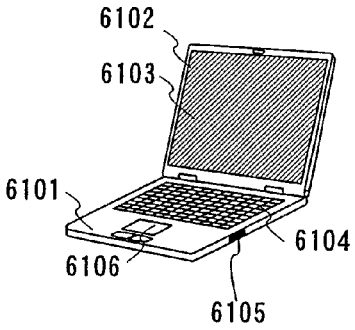

FIG. 20B is a computer including a main body 6101, a housing 6102, a display portion 6103, a keyboard 6104, an external connecting port 6105, a pointing mouse 6106 and the like. In this computer, the display portion 6103 is constructed of a matrix arrangement of the pixels in the semiconductor device described in embodiment mode. In the semiconductor device, on/off potentials applied to a gate electrode of a driving transistor can be set separately from a potential of a data line, and a constant potential can be continuously supplied to the gate terminal of the driving transistor regardless of whether a light-emitting element in the pixel is in the emission state or non-emission state. Accordingly, the potential amplitude of the data line can be set small to reduce power consumption, and more stable operation can be performed as compared to the conventional pixel configuration where a potential is held in a holding capacitor. Since the display portion 6103 constructed of such a semiconductor device has a similar function, the computer can achieve low power consumption and stable display operation. With such characteristics, the power source circuits can be significantly reduced in number or scale to reduce defective display; therefore, reduction in size and weight of the main body 6101 and the housing 6102 can be achieved. Since the computer in accordance with the invention can achieve reduction in power consumption and weight, products with improved portability can be provided to customers.

Figure 20C:
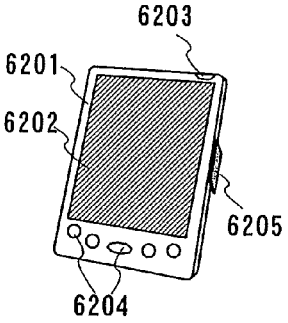

FIG. 20C is a portable computer including a main body 6201, a display portion 6202, a switch 6203, operating keys 6204, an IR port 6205 and the like. In this portable computer, the display portion 6202 is constructed of a matrix arrangement of the pixels in the semiconductor device described in embodiment mode. In the semiconductor device, on/off potentials applied to a gate electrode of a driving transistor can be set separately from a potential of a data line, and a constant potential can be continuously supplied to the gate terminal of the driving transistor regardless of whether a light-emitting element in a pixel is in the emission state or non-emission state. Accordingly, the potential amplitude of the data line can be set small to reduce power consumption, and more stable operation can be performed as compared to the conventional pixel configuration where a potential is held in a holding capacitor. Since the display portion 6202 constructed of such a semiconductor device has a similar function, the portable computer can achieve low power consumption and stable display operation. With such characteristics, the power source circuits can be significantly reduced in number or scale to reduce defective display; therefore, reduction in size and weight of the main body 6201 can be achieved. Since the portable computer in accordance with the invention can achieve reduction in power consumption and weight, products with improved portability can be provided to customers.

Figure 20D:
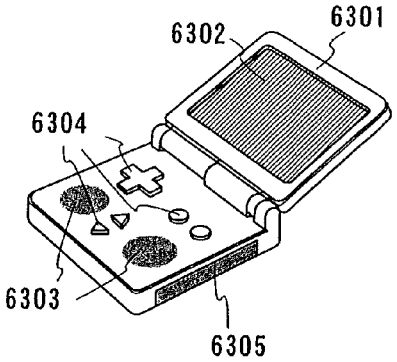

FIG. 20D is a portable game machine including a housing 6301, a display portion 6302, speaker portions 6303, operating keys 6304, a recording-medium insert socket 6305 and the like. In this portable game machine, the display portion 6302 is constructed of a matrix arrangement of the pixels in the semiconductor device described in embodiment mode. In the semiconductor device, on/off potentials applied to a gate electrode of a driving transistor can be set separately from a potential of a data line, and a constant potential can be continuously supplied to the gate terminal of the driving transistor regardless of whether a light-emitting element in a pixel is in the emission state or non-emission state. Accordingly, the potential amplitude of the data line can be set small to reduce power consumption, and more stable operation can be performed as compared to the conventional pixel configuration where a potential is held in a holding capacitor. Since the display portion 6302 constructed of such a semiconductor device has a similar function, the portable game machine can achieve low power consumption and stable display operation. With such characteristics, the power source circuits can be significantly reduced in number or scale to reduce defective display; therefore, reduction in size and weight of the housing 6301 can be achieved. Since the portable gate machine in accordance with the invention can achieve reduction in power consumption and weight, products with improved portability can be provided to customers.

Figure 20E:
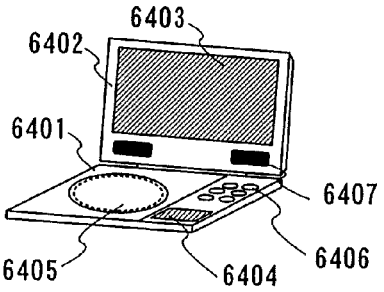
Figure 21:
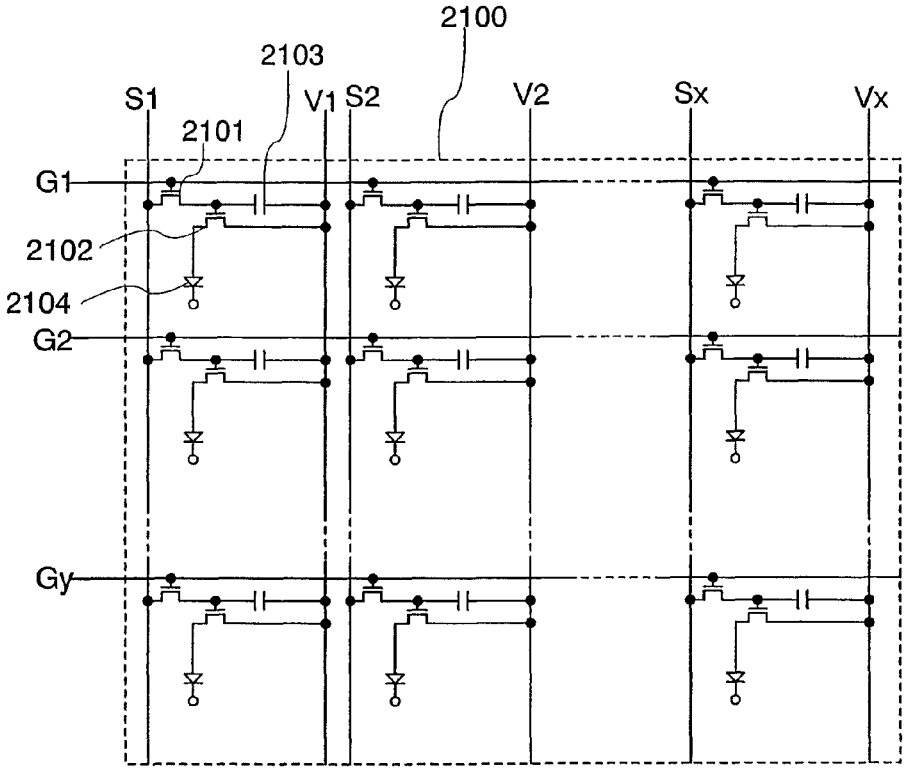
FIG. 21 shows a conventional pixel configuration.
Figure 22A:
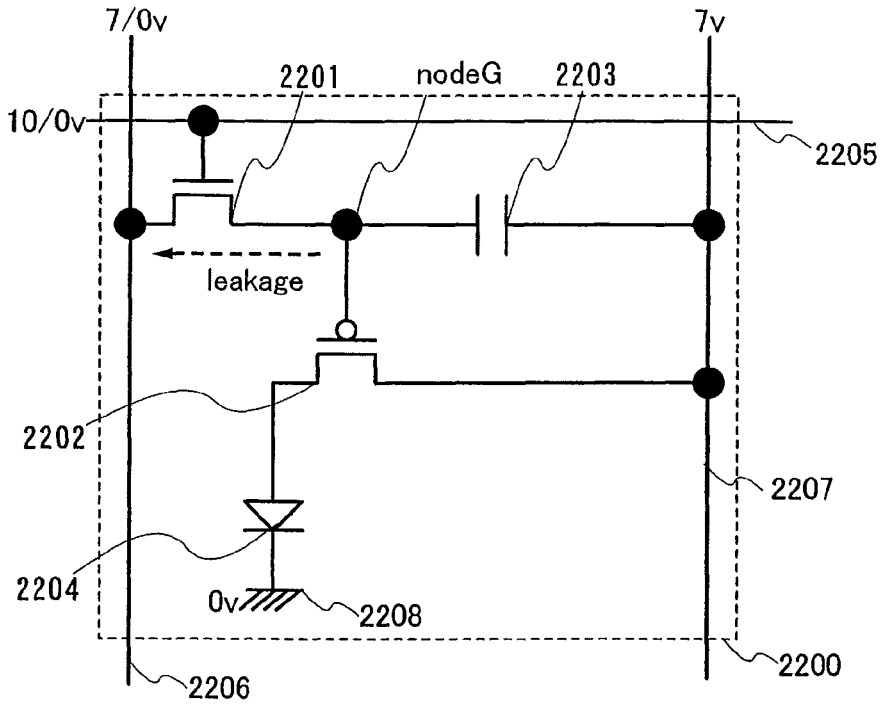
FIG. 22A and FIG. 22B show problems in a conventional pixel configuration.
Figure 22B:
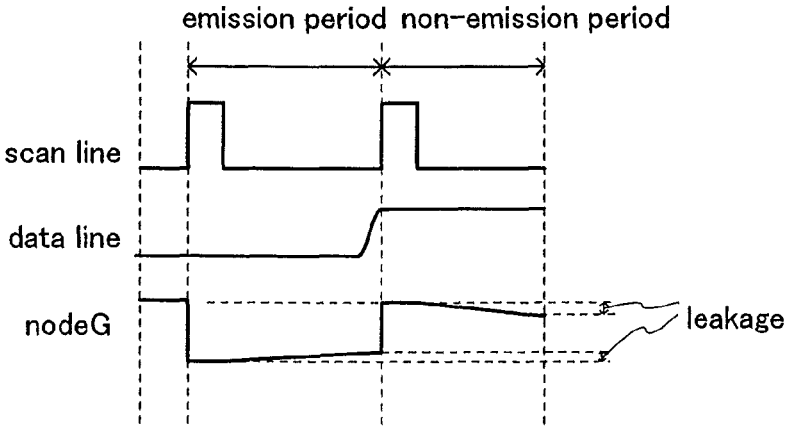
PRIOR ART FIG.22B

FIG. 20E is a portable image reproducing device provided with a recording medium (specifically, a DVD reproducing device) including a main body 6401, a housing 6402, a display portion A6403, a display portion B6404, a recording medium (e.g., a DVD) reading portion 6405, an operating key 6406, a speaker portion 6407 and the like. The display portion A6403 mainly displays image data, and the display portion B6404 mainly displays text data. In this portable image reproducing device, each of the display portion A6403 and the display portion B6404 is constructed of a matrix arrangement of the pixels in the semiconductor device described in embodiment mode. In the semiconductor device, on/off potentials applied to a gate electrode of a driving transistor can be set separately from a potential of a data line, and a constant potential can be continuously supplied to the gate terminal of the driving transistor regardless of whether a light-emitting element in a pixel is in the emission state or non-emission state. Accordingly, the potential amplitude of the data line can be set small to reduce power consumption, and more stable operation can be performed as compared to the conventional pixel configuration where a potential is held in a holding capacitor. Since the display portion A6403 and the display portion B6404 each constructed of such a semiconductor device has a similar function, the portable image reproducing device can achieve low power consumption and stable display operation. With such characteristics, the power source circuits can be significantly reduced in number or scale to reduce defective display; therefore, reduction in size and weight of the main body 6401 and the housing 6402 can be achieved. Since the portable image reproducing device in accordance with the invention can achieve reduction in power consumption and weight, products with improved portability can be provided to customers.

Display devices used in such electronic apparatuses can be formed by using not only a glass substrate but also a heat-resistant plastic substrate in accordance with size, strength or applications. Accordingly, even more reduction in weight can be achieved.

Note that in each display portion used for the aforementioned electronic apparatuses, a semiconductor device shown in embodiment mode is provided. Therefore, even when a signal supply is stopped to a memory circuit in each pixel of a pixel portion from a scan line driver circuit and a data line driver circuit that are disposed on the periphery of the pixel portion, signal data that has been supplied until immediately before the signal supply is stopped can be held, and thus the light-emitting element can hold the emission state or non-emission state even under the aforementioned circumstance. Therefore, neither the scan line driver circuit nor the data line driver circuit is required to be operated for displaying still images or the like by using the semiconductor device of the invention, and thus a significant reduction in power consumption can be expected. Accordingly, products with reduced power consumption even in displaying still images can be provided to customers.

Note that examples shown in this embodiment are only exemplary, and therefore, the invention is not limited to such applications.

This embodiment can be freely implemented in combination with any of the aforementioned embodiment mode and other embodiments.

The present application is based on Japanese Priority application No. 2005-121730 filed on Apr. 19, 2005 with the Japanese Patent Office, the entire contents of which are hereby incorporated by reference.

What is claimed is:

1. A semiconductor device comprising:

a pixel, the pixel comprising:

a first transistor, wherein a gate of the first transistor is electrically connected to a first line;

a second transistor, wherein one of a source and a drain of the second transistor is directly electrically connected to one of a source and a drain of the first transistor, and a gate of the second transistor is electrically connected to a second line;

a third transistor, wherein a gate of the third transistor is electrically connected to the other one of the source and the drain of the second transistor, and one of a source and a drain of the third transistor is electrically connected to a third line; and a light emitting element electrically connected to the other one of the source and the drain of the third transistor, wherein the first line is a data line, wherein the first transistor and the second transistor are connected in series, wherein the other one of the source and the drain of the first transistor is not electrically connectable to the one of the source and the drain of the third transistor, wherein at least one of the first transistor, the second transistor and the third transistor comprises:

a semiconductor film;

a gate insulating film adjacent to the semiconductor film; and a gate electrode adjacent to the semiconductor film with the gate insulating film interposed therebetween, and wherein the semiconductor film comprises an oxide semiconductor comprising indium.

2. The semiconductor device according to claim 1, wherein the oxide semiconductor further comprises gallium and zinc.

3. The semiconductor device according to claim 1, wherein the oxide semiconductor is an amorphous oxide semiconductor.

4. The semiconductor device according to claim 1, wherein the second line is a scan line.

5. The semiconductor device according to claim 1, wherein the third line is a power source line.

6. The semiconductor device according to claim 1, further comprising a power source line electrically connected to the other one of the source and the drain of the first transistor.

7. The semiconductor device according to claim 1, further comprising a memory circuit electrically connected the gate of the third transistor.

8. The semiconductor device according to claim 1, wherein the gate insulating film comprises silicon oxide.

9. An electronic book comprising the semiconductor device according to claim 1.

10. The semiconductor device according to claim 1, further comprising:

a second pixel, the second pixel comprising:

a fourth transistor, wherein a gate of the fourth transistor is electrically connected to the first line;

a fifth transistor, wherein one of a source and a drain of the fifth transistor is electrically connected to one of a source and a drain of the fourth transistor, and a gate of the fifth transistor is electrically connected to a fourth line;

a sixth transistor, wherein a gate of the sixth transistor is electrically connected to the other one of the source and the drain of the fifth transistor, and one of a source and a drain of the sixth transistor is electrically connected to the third line; and a light emitting element electrically connected to the other one of the source and the drain of the sixth transistor, wherein the other one of the source and the drain of the first transistor of the pixel and the other one of the source and the drain of the fourth transistor of the second pixel are electrically connected a fifth line.

11. The semiconductor device according to claim 10, wherein the oxide semiconductor further comprises gallium and zinc.

12. The semiconductor device according to claim 10, wherein the oxide semiconductor is an amorphous oxide semiconductor.

13. The semiconductor device according to claim 10, wherein the second line is a scan line.

14. The semiconductor device according to claim 10, wherein the third line is a power source line.

15. The semiconductor device according to claim 10, wherein the fifth line is a power source line.

16. The semiconductor device according to claim 10, further comprising a memory circuit electrically connected the gate of the third transistor.

17. The semiconductor device according to claim 10, wherein the gate insulating film comprises silicon oxide.

18. An electronic book comprising the semiconductor device according to claim 10.

19. A semiconductor device comprising:

a plastic substrate; and a pixel over the plastic substrate, the pixel comprising:

a first transistor, wherein a gate of the first transistor is electrically connected to a first line;

a second transistor, wherein one of a source and a drain of the second transistor is directly electrically connected to one of a source and a drain of the first transistor, and a gate of the second transistor is electrically connected to a second line;

a third transistor, wherein a gate of the third transistor is electrically connected to the other one of the source and the drain of the second transistor, and one of a source and a drain of the third transistor is electrically connected to a third line; and a light emitting element electrically connected to the other one of the source and the drain of the third transistor, wherein the first line is a data line, wherein the first transistor and the second transistor are connected in series, wherein the other one of the source and the drain of the first transistor is not electrically connectable to the one of the source and the drain of the third transistor, wherein at least one of the first transistor, the second transistor and the third transistor comprises:

a semiconductor film;

a gate insulating film adjacent to the semiconductor film; and a gate electrode adjacent to the semiconductor film with the gate insulating film interposed therebetween, and wherein the semiconductor film comprises an oxide semiconductor comprising indium.

20. The semiconductor device according to claim 19, wherein the oxide semiconductor further comprises gallium and zinc.

21. The semiconductor device according to claim 19, wherein the oxide semiconductor is an amorphous oxide semiconductor.

22. The semiconductor device according to claim 19, wherein the second line is a scan line.

23. The semiconductor device according to claim 19, wherein the third line is a power source line.

24. The semiconductor device according to claim 19, further comprising a power source line electrically connected to the other one of the source and the drain of the first transistor.

25. The semiconductor device according to claim 19, further comprising a memory circuit electrically connected the gate of the third transistor.

26. The semiconductor device according to claim 19, wherein the gate insulating film comprises silicon oxide.

27. An electronic book comprising the semiconductor device according to claim 19.

* * * * *